US011291285B2

(12) United States Patent
Linton et al.

(10) Patent No.: US 11,291,285 B2
(45) Date of Patent: Apr. 5, 2022

(54) WIRELESS HOT SHAVING CREAM DISPENSER

(71) Applicant: LTHR, Inc., Venice, CA (US)

(72) Inventors: Andrew Linton, York (GB); Robert Firth, Pocklington (GB); Robert Riley, York (GB); Eamon Croghan, Monk Bretton (GB)

(73) Assignee: LTHR, Inc., Venice, CA (US)

( * ) Notice: Subject to any disclaimer, the term of this patent is extended or adjusted under 35 U.S.C. 154(b) by 0 days.

(21) Appl. No.: 17/273,362

(22) PCT Filed: Sep. 6, 2019

(86) PCT No.: PCT/US2019/049866

§ 371 (c)(1),
(2) Date: Mar. 4, 2021

(87) PCT Pub. No.: WO2020/051405

PCT Pub. Date: Mar. 12, 2020

(65) Prior Publication Data

US 2021/0307481 A1 Oct. 7, 2021

Related U.S. Application Data

(60) Provisional application No. 62/728,239, filed on Sep. 7, 2018.

(51) Int. Cl.
*A45D 27/10* (2006.01)
*A45D 34/00* (2006.01)

(52) U.S. Cl.
CPC ..... *A45D 27/10* (2013.01); *A45D 34/00* (2013.01); *A45D 2200/056* (2013.01); *A45D 2200/155* (2013.01)

(58) Field of Classification Search
CPC ..... B05B 9/002; B65D 83/20; B65D 83/72; B65D 83/75; A45D 27/02; A45D 27/04;
(Continued)

(56) References Cited

U.S. PATENT DOCUMENTS 2,310,379 A 2/1943 Wahl
2,517,539 A 8/1950 Brown
(Continued)

FOREIGN PATENT DOCUMENTS

GB 748411 A 5/1956

OTHER PUBLICATIONS

Hammacher Schlemmer, "Heated Shaving Lather Dispenser" webpage, Apr. 19, 2014.

*Primary Examiner* — Vishal Pancholi
*Assistant Examiner* — Robert K Nichols, II
(74) *Attorney, Agent, or Firm* — Verrill Dana, LLP

(57) ABSTRACT

A wireless hot shaving cream dispenser is provided. The dispenser includes a nozzle extending from a housing for dispensing a foam output. A flow path extends within the housing from a soap solution reservoir to the nozzle. A disrupter on the flow path downstream from the reservoir has a convoluted surface on the flow path to form a foam from soap solution flowing along the flow path. A heating assembly heats the dispenser to provide heat to the foam on the flow path, and a pump pumps soap solution from the reservoir through the disrupter to the nozzle along the flow path. A method of producing a hot shaving cream lather using the dispenser is provided.

11 Claims, 20 Drawing Sheets

(58) Field of Classification Search
CPC ..... A45D 27/06; A45D 27/10; A45D 27/12; A45D 34/00; A45D 2200/056; A45D 2200/155; A45K 5/14
USPC ..... 222/146.1, 190, 23, 146.2; 392/477
See application file for complete search history.

(56) References Cited

U.S. PATENT DOCUMENTS

| | | | | |
|---|---|---|---|---|
| 2,756,102 | A | 7/1956 | Switzer | |
| 2,871,058 | A | 1/1959 | Puglia | |
| 3,095,122 | A | 6/1963 | Lewiecki et al. | |
| 3,291,346 | A | 12/1966 | Marraffino | |
| 3,308,993 | A | 3/1967 | Bruno | |
| 3,358,885 | A | 12/1967 | Flowers | |
| 3,490,651 | A | 1/1970 | Abplanalp | |
| 3,498,504 | A | 3/1970 | Wilkins | |
| 3,588,467 | A | 6/1971 | Grosjean et al. | |
| 3,710,985 | A | 1/1973 | Baum | |
| 3,712,512 | A | 1/1973 | Snider, Jr. et al. | |
| 3,749,880 | A | 7/1973 | Meeks | |
| 3,891,827 | A * | 6/1975 | Wyse | H05B 3/16 392/477 |
| 3,990,612 | A | 11/1976 | Gasser | |
| 3,997,083 | A | 12/1976 | McNair | |
| 4,056,707 | A | 11/1977 | Farnam | |
| 4,327,076 | A | 4/1982 | Puglia et al. | |
| 4,349,131 | A | 9/1982 | Arabian | |
| 4,439,416 | A | 3/1984 | Cordon et al. | |
| D308,117 | S | 5/1990 | Badgett | |
| 6,056,160 | A | 5/2000 | Carlucci et al. | |
| 6,216,911 | B1 | 4/2001 | Kreitemier et al. | |
| 6,311,868 | B1 | 11/2001 | Krietemeier et al. | |
| 6,415,957 | B1 | 7/2002 | Michaels et al. | |
| 6,454,127 | B1 | 9/2002 | Suomela et al. | |
| 6,795,645 | B2 * | 9/2004 | Hygema | B05B 9/002 219/214 |
| 6,978,912 | B2 | 12/2005 | Taylor et al. | |
| 7,208,707 | B2 | 4/2007 | Clothier et al. | |
| 7,661,562 | B2 | 2/2010 | Tyrrell et al. | |
| 8,061,918 | B2 | 11/2011 | Skalitzky et al. | |
| 8,261,950 | B2 | 9/2012 | Cittadino | |
| 8,336,738 | B2 | 12/2012 | Bouix et al. | |
| 9,133,329 | B2 | 9/2015 | Denome et al. | |
| D749,263 | S | 2/2016 | Pleshek et al. | |
| 2002/0017532 | A1 * | 2/2002 | Aiken | B65D 83/72 221/96 |
| 2009/0014472 | A1 | 1/2009 | Farmer | |
| 2011/0067576 | A1 | 3/2011 | White et al. | |
| 2015/0360187 | A1 | 12/2015 | Varone | |
| 2017/0066149 | A1 | 3/2017 | Hodgson et al. | |

* cited by examiner

WIRELESS HOT SHAVING CREAM DISPENSER

CROSS REFERENCE TO RELATED APPLICATIONS

This application claims priority under 35 U.S.C. § 119(e) of U.S. Provisional Application No. 62/728,239, filed on Sep. 7, 2018, entitled "Wireless Hot Shaving Cream Dispenser," the disclosure of which is hereby incorporated by reference.

STATEMENT REGARDING FEDERALLY SPONSORED RESEARCH AND DEVELOPMENT

N/A

BACKGROUND

The heating of shaving cream for shaving has been practiced in barber shops. Systems for heating shaving cream by barber shops are often not suitable for use by individuals at home or while traveling.

SUMMARY

A hot shaving cream dispenser is provided that can be used by an individual in the home or while traveling. The device can mix a soap solution into a lather or foam, can heat the lather to a desirable temperature, and can dispense the hot lather as shaving cream having a consistent lather or foam quality. The user can fill the device with additional soap solution when needed. The device can use a battery power source for wireless operation and can include a charging port for recharging the battery power source.

More particularly, a hot shaving cream dispenser can include a housing, with a nozzle for dispensing a foam extending from the housing. A soap solution reservoir is disposed within the housing. A flow path extends within the housing from the reservoir to the nozzle. A disrupter is provided on the flow path downstream from the reservoir. The disrupter includes a convoluted surface on the flow path to form a foam from soap solution flowing along the flow path. A heating assembly is disposed to heat the disrupter to provide heat to the foam on the flow path. A pump is disposed to pump soap solution from the reservoir through the disrupter to the nozzle along the flow path.

A method of producing a hot shaving cream lather is also provided using a hot shaving cream dispenser as described herein. A soap solution is placed in the soap solution reservoir. A power switch is operated to turn on the heating assembly to heat the disrupter. When the disrupter has been sufficiently heated, a dispense switch can be operated to turn on a pump to flow a soap solution through the disrupter for dispensing as a hot lather or foam out of the nozzle.

DESCRIPTION OF THE DRAWINGS

Reference is made to the following detailed description taken in conjunction with the accompanying drawings in which.

DETAILED DESCRIPTION

Figure 2:
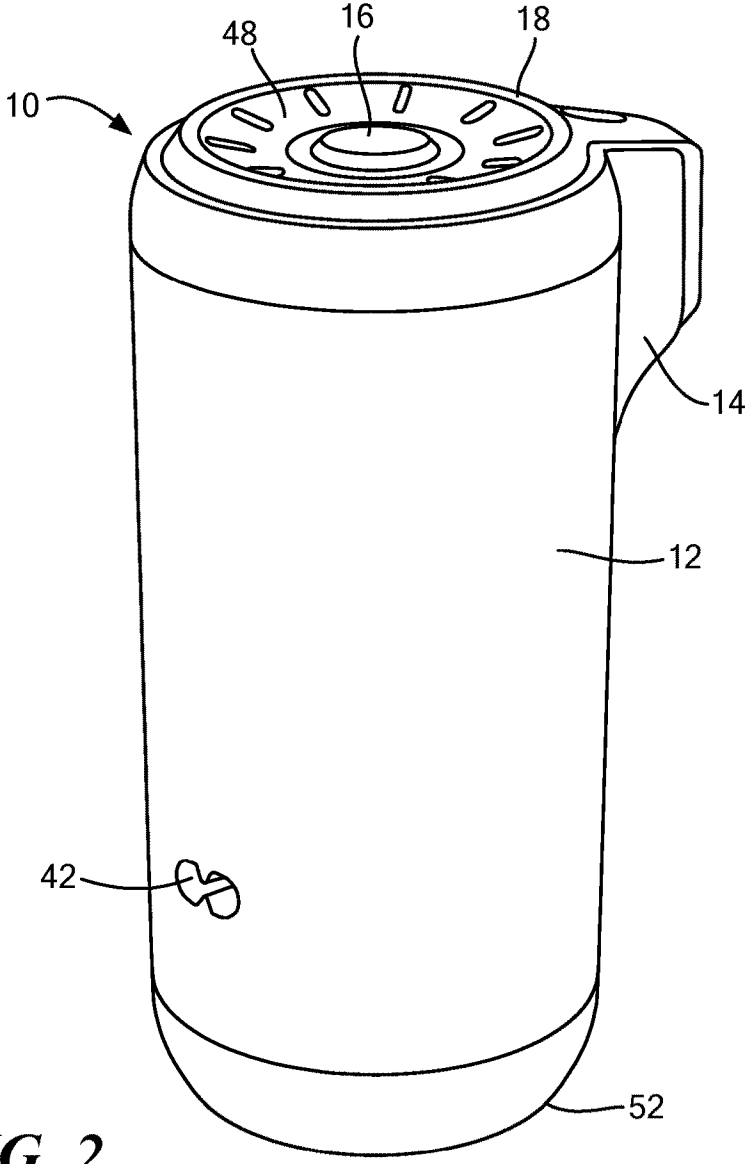
FIG. 2 is an opposite isometric view of the dispenser of FIG. 1.
Figure 1:
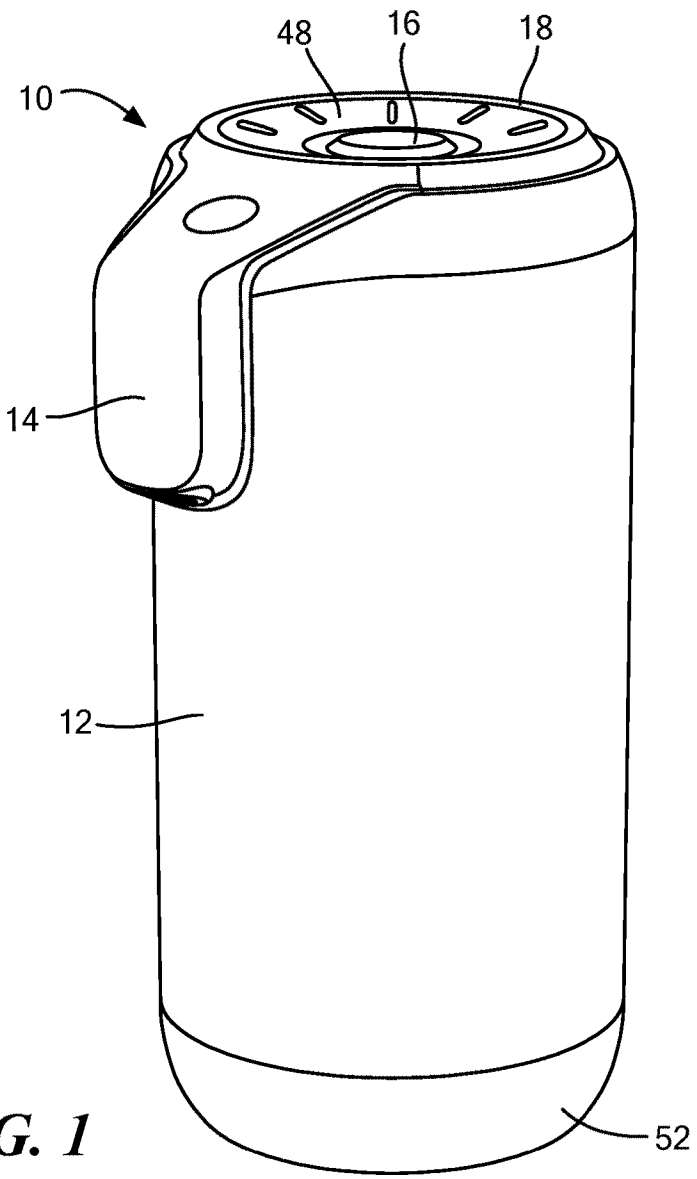
FIG. 1 is an isometric view of a hot shaving cream dispenser.

This application incorporates by reference the entire disclosure of U.S. Provisional Application No. 62/728,239, filed on Sep. 7, 2018, entitled "Wireless Hot Shaving Cream Dispenser."

FIGS. 1-24 illustrate a hot shaving cream dispenser 10. The dispenser includes a housing 12 enclosing internal components, described further below. A nozzle 14 is provided through which heated shaving cream can be dispensed as a lather or foam. The outlet of the nozzle can be displaced from the body of the housing to prevent dribbling of the foam down the housing. A power button 16, to activate a heating assembly, can be located on the top 18 of the housing. Similarly, a dispense button 22, to cause the device to dispense heated lather or foam, can be located on the top of the housing. The dispense button can be located on the nozzle for access by a user's thumb while holding the palm of the hand beneath the nozzle.

Referring to FIGS. 6-12, internal components can include a reservoir 24 to hold a soap solution, a pump 26 to move the soap solution through the device, a disrupter 28 to generate foam having a consistent foam quality and to heat the foam, and a heating assembly 32 to provide heat to the disrupter. A flow path for the soap solution is provided through the housing from the reservoir 24, passing through the pump 26 and the disrupter 28, to the nozzle 14.

Additional internal components include a power source 36 and electronic control circuitry 38. The power source can include one or more batteries located in an appropriate region or chamber within the housing. In some embodiments, the batteries can be located in a region of the housing surrounding or adjacent to the pump. The one or more batteries can be rechargeable, and a charging port 42 for plugging in a charging cable can be provided in any suitable location on the housing, for example, at a lower location on a side opposite the nozzle. Lithium ion or any other suitable batteries can be used. Structural elements 44 can be provided within the housing to support the internal components.

An anti-slip material, such as a rubberized stand ring 46, can be provided on the bottom surface 52 of the housing 12. The upper surface 18 of the housing can be formed of a rubberized material 48 to provide an anti-slip stand ring when the housing is inverted to allow the user to refill the reservoir with fresh soap solution. Indicator lights 54, such as LED lights, can be located at the top of the housing to provide various status indications to a user.

Referring more particularly to FIGS. 5, 6, 11, and 12, the reservoir 24 for containing a soap solution can be located internally at a bottom portion of the housing 12. The location at the bottom portion of the housing is convenient for refilling the dispenser with fresh soap solution. In some embodiments, the reservoir can be removable from the housing, such that, when the soap solution has been depleted, a new reservoir filled with fresh soap solution can be inserted into the housing. In some embodiments, the reservoir can be removed, filled with fresh soap solution, and replaced in the housing. In some embodiments, a removable cap can be provided at the bottom of the housing to allow a user to refill the reservoir with a soap solution after removing the cap.

Figure 6:
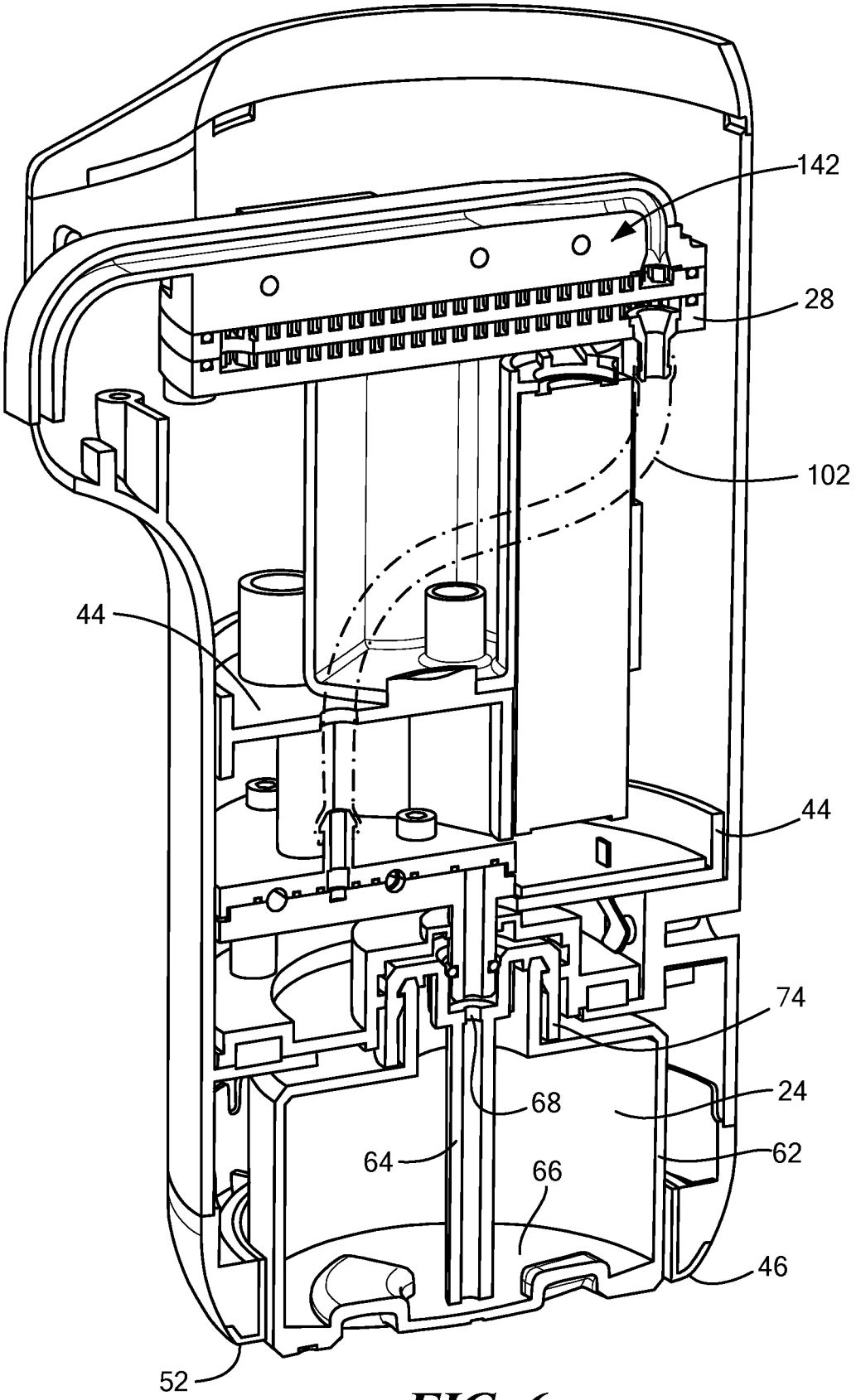
FIG. 6 is a sectional view of the dispenser of FIG. 1.
Figure 7:
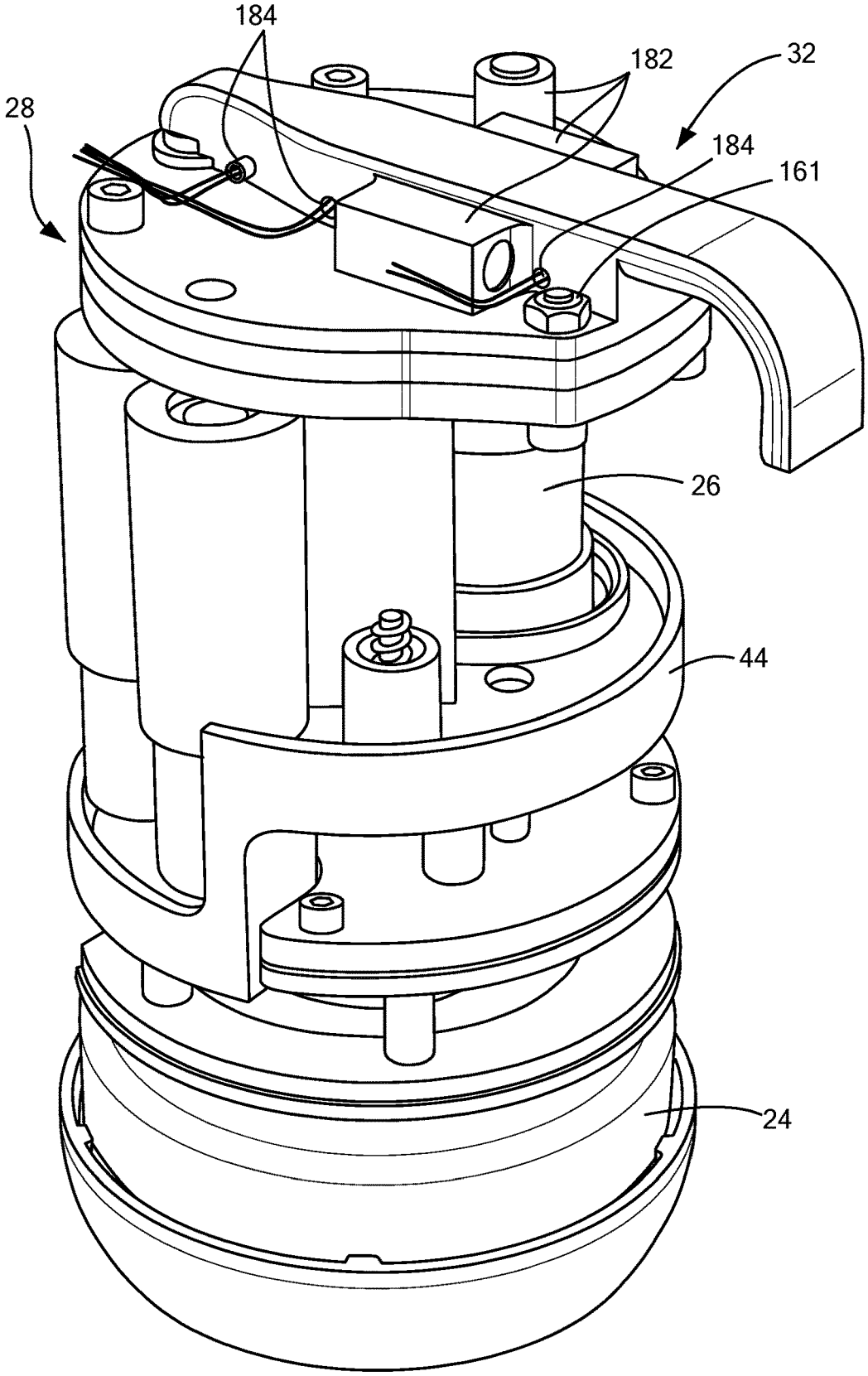
FIG. 7 is an isometric view of internal components of the dispenser of FIG. 1.
Figure 8:
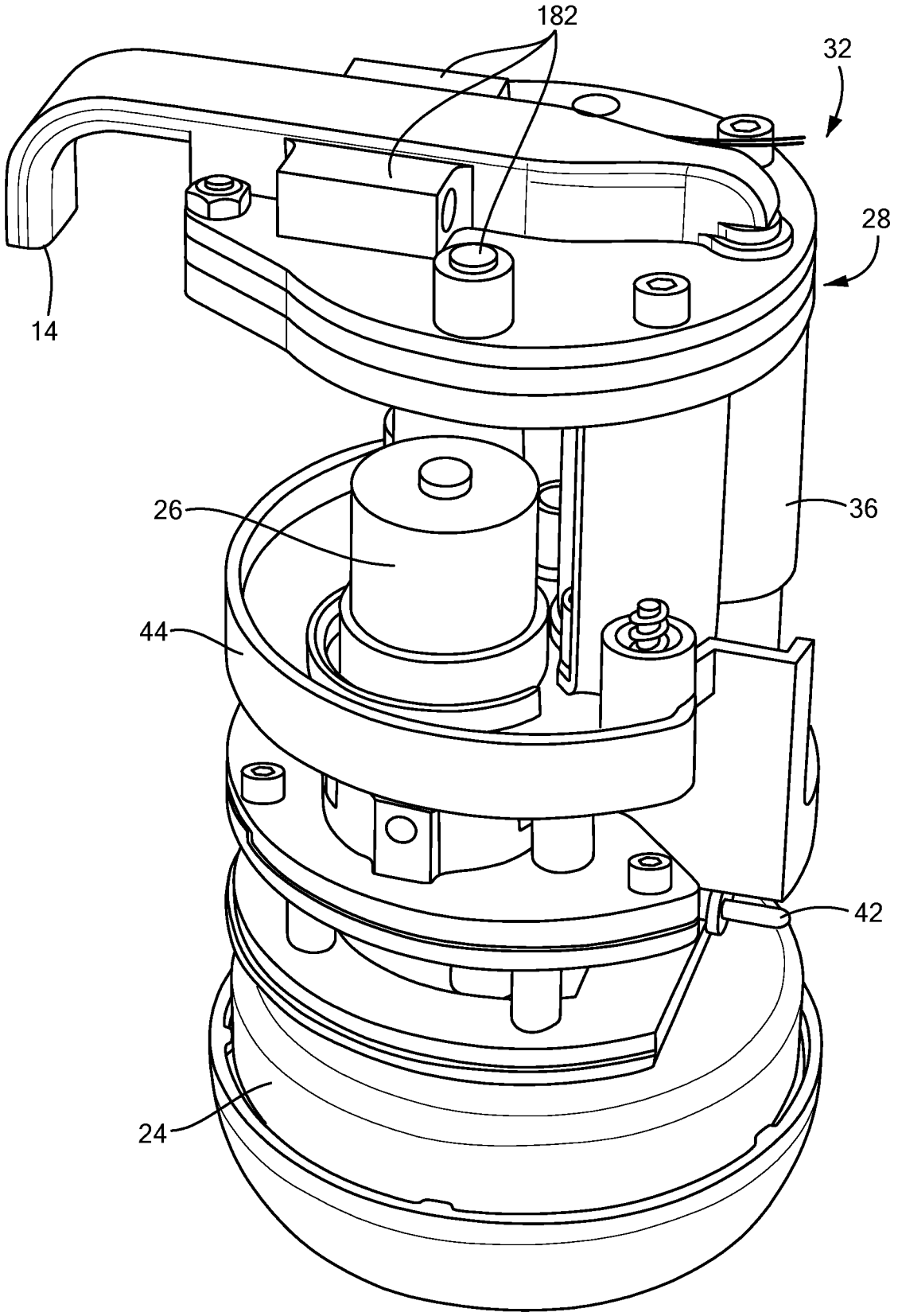
FIG. 8 is a further isometric view of internal components of the dispenser of FIG. 1.
Figure 11:
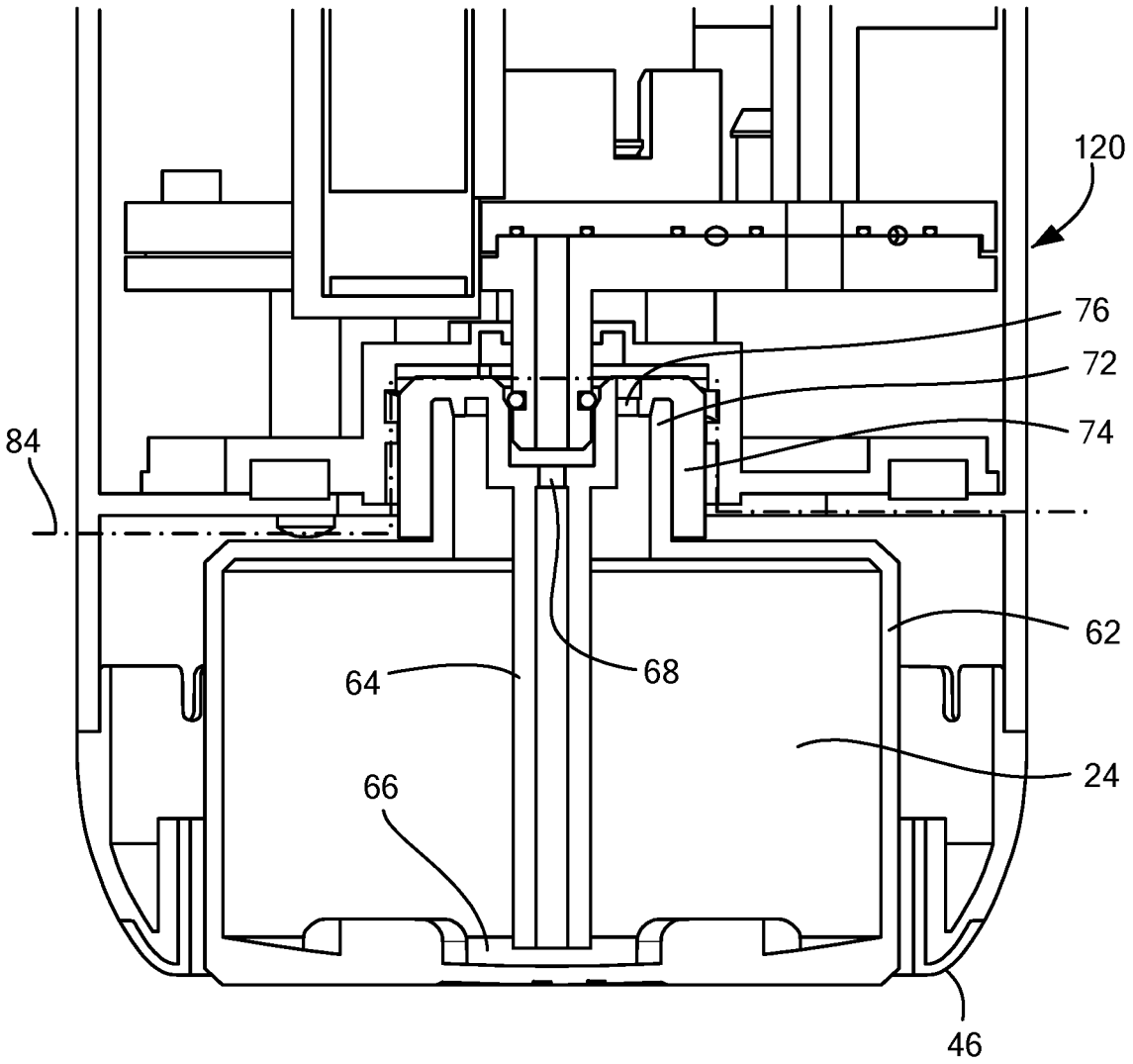
FIG. 11 is a partial cutaway view of internal components of the dispenser of FIG. 1.
Figure 12:
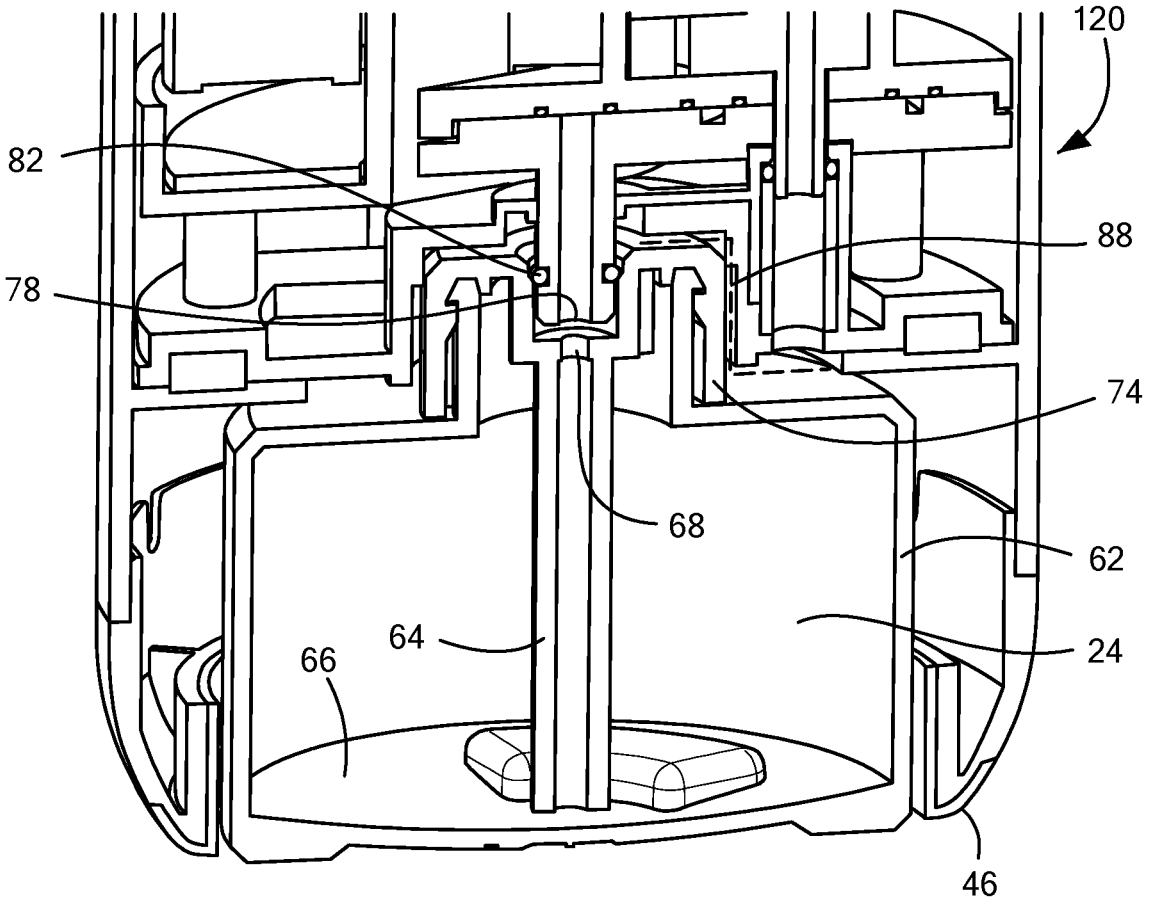
FIG. 12 is a further partial cutaway view of internal components of the dispenser of FIG. 1.

FIGS. 5, 6, 11, and 12 illustrate a removable soap solution reservoir 24. The reservoir can include a container 62 configured to fit within the bottom portion of the housing. The container can be pre-filled with a suitable amount of soap solution. A tube 64 can be vertically disposed within the container from a location at or near the bottom 66 to a location at or near the top of the container. Soap solution in the container can be withdrawn out of the reservoir through the tube by the pump when the pump has been activated. The tube can help ensure that the soap solution output from the reservoir does not vary as the volume in the reservoir and pressure head are reduced as the soap solution is withdrawn. As shown in FIGS. 6, 11, and 12, the outlet 68 of the tube can be in fluid communication with an inlet to the pump 26 via a flow restrictor 120, described further below.

As also illustrated in FIGS. 6, 11, and 12, the container can include an upstanding neck 72 surrounding an upper portion of the tube. A cap 74 can be placed over the upstanding neck, with an opening therein for the outlet 68 of the tube. The cap can be integrally formed with the tube. An air release valve 76 can be provided in the cap. An inlet 78 to the pump or to the flow restrictor can be aligned with the outlet 68 of the tube 64 and sealed to the cap with a sealing element 82, such as an O-ring. In this manner, the interior of the housing above the reservoir, including the electronics, can be sealed from the ingress of water, illustrated schematically by dashed line 84 in FIG. 11, in the event a user drops the dispenser in water or the dispenser otherwise contacts water. An air path, indicated schematically by dashed line 88 in FIG. 12, can also prevent inflow of water past the seal, such than any water will go into the reservoir.

Figure 4:
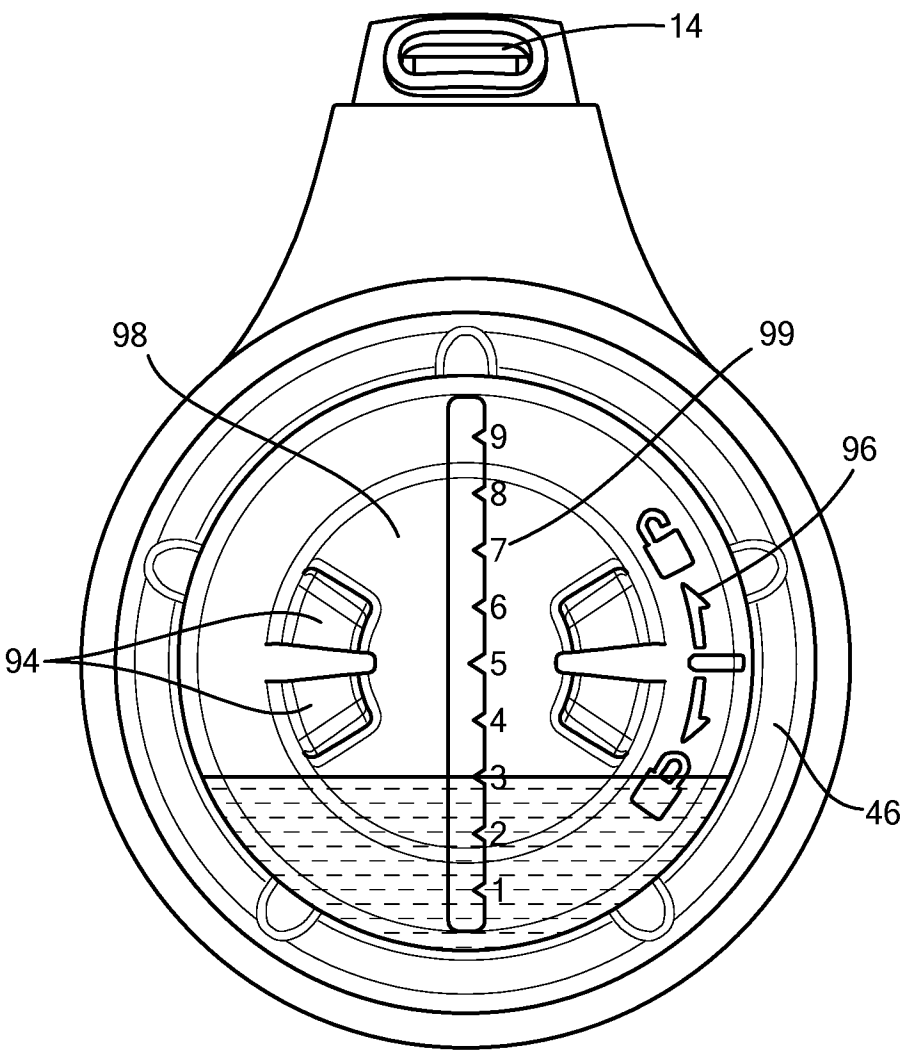
FIG. 4 is a bottom view of the dispenser of FIG. 1.
Figure 3:
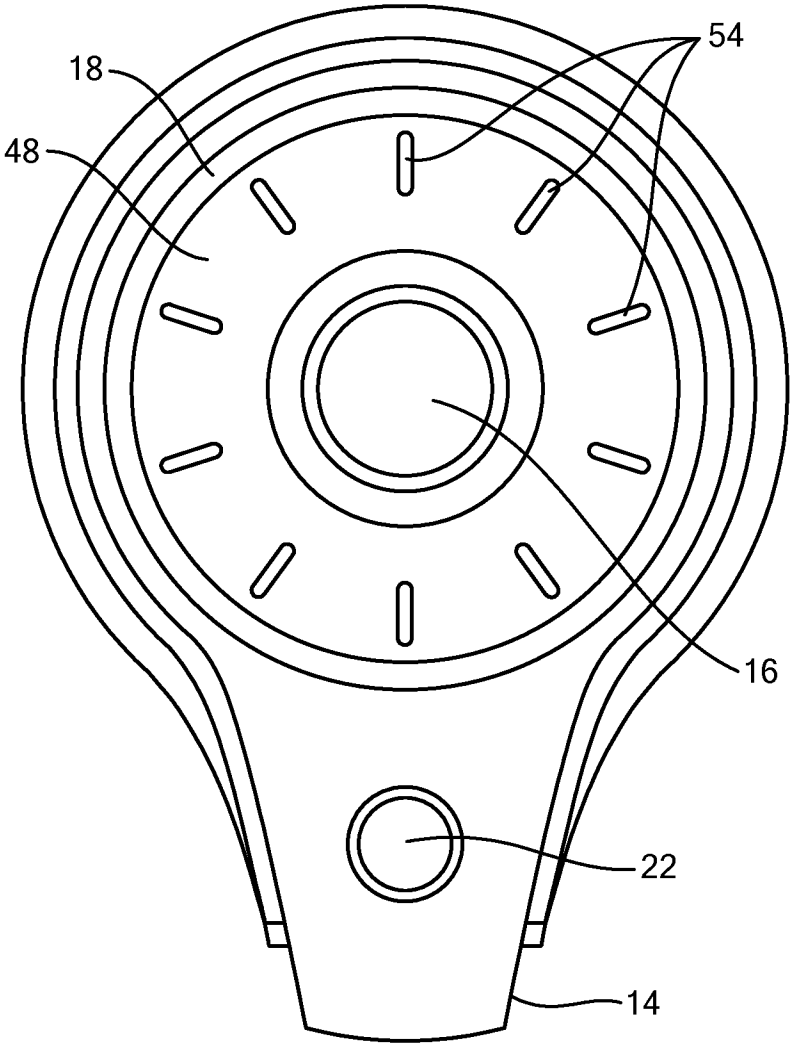
FIG. 3 is a top view of the dispenser of FIG. 1.
Figure 5:
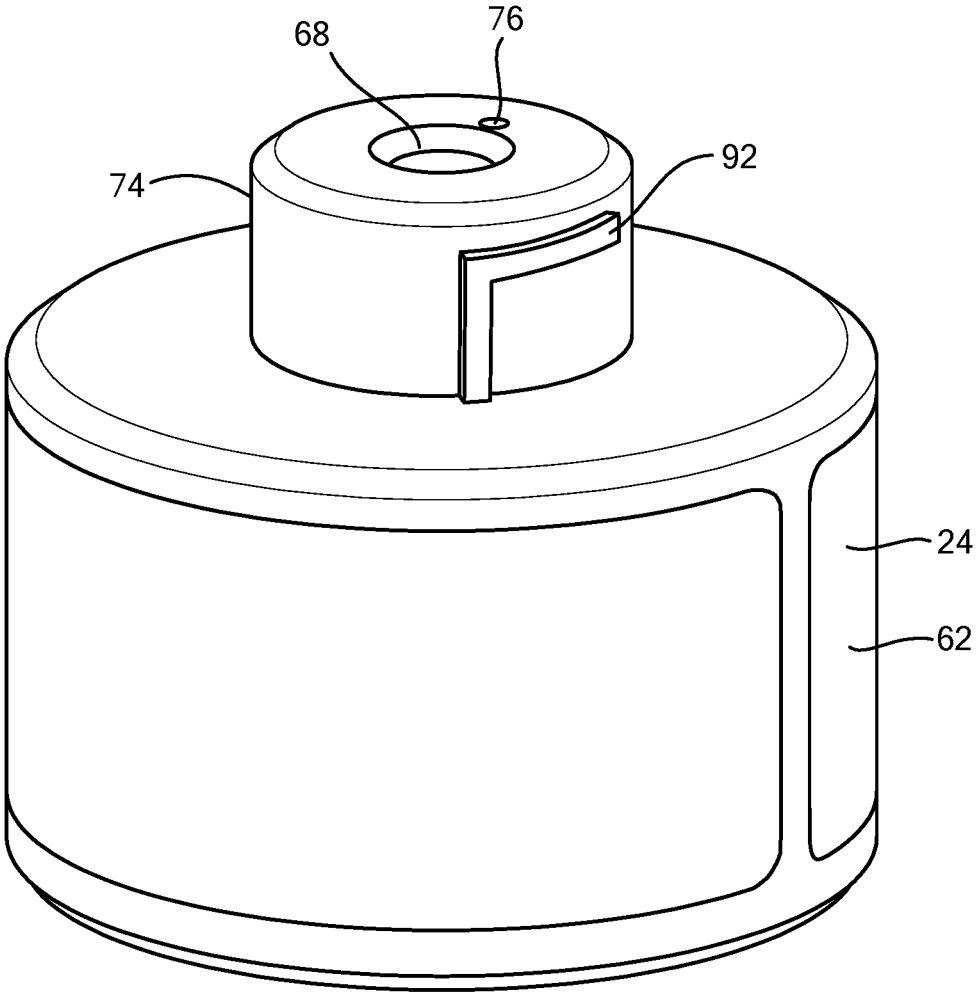
FIG. 5 is an isometric view of a reservoir used in the dispenser of FIG. 1.

The reservoir can be removably mounted within the housing in any suitable manner. For example, a locking mechanism such as a threaded fitting or bayonet mount 92 (FIG. 5), can be provided on the cap of the reservoir and mating elements can be provided on a surface of a structural element within the housing. Referring to FIG. 4, the reservoir can include finger grips 94 on a bottom surface configured for a user to rotate the reservoir in one direction to insert it into the housing and in an opposite direction to remove it from the housing. The bottom surface can include markings 96 to indicate which direction to rotate for locking and for unlocking the reservoir. In some embodiments, a removable closure can be provided for the bottom of the housing, which can also serve to retain the reservoir within the housing.

The reservoir can include a translucent or transparent bottom surface 98 so that a user can visually determine how much soap solution is present within the reservoir. The bottom surface can include a fill level indicator. The fill level indicator can include markings 99 indicative of the number of doses of foam left in the reservoir.

Referring to FIGS. 6-10, the pump 26 can be located above the reservoir, generally in a central region of the housing. The pump can be coupled as closely as possible to the reservoir, to minimize the amount of work that the pump must do, particularly if the pump is disposed above the reservoir. A conduit 102 (indicted in phantom in FIG. 6) can lead from a pump outlet to an inlet to the disruptor 28 above the pump.

The pump 26 can be low-flow and self-priming. A pump with a low flow rate can provide a low speed solution infeed to the disrupter. In this manner, the soap solution can be fed into the disrupter in consistent and controlled amounts at relatively slow speed, which helps create a desired or optimal foam consistency. The priming and flow rate can be sufficiently stable through the full dispense of the volume of soap solution in the soap reservoir. The voltage of the pump can be low, for example, as low as 6V, to reduce the overall power consumption.

A pump that can pump both liquid and air can be used, such as a membrane pump or diaphragm pump. Some membrane or diaphragm pumps can pump much larger volumes of air than liquid. The pump can include a valve to regulate flow of a soap solution from the soap solution reservoir and a valve to regulate a flow of air to provide alternating pockets of air and soap solution, which subsequently get mixed together by the disrupter to form a foam. The pump can provide an output that is at least about 85% air by volume, at least 90% air by volume, at least 95% air by volume. Preferably the pump can provide an output ranging from 85% to 98% air by volume; and more preferably 92% to 95% air by volume. In some embodiments, the pump can provide an output of about 94%±2% air by volume.

A commercially available pump can be used. It will be appreciated that other types of pump can also be used.

Figure 13:
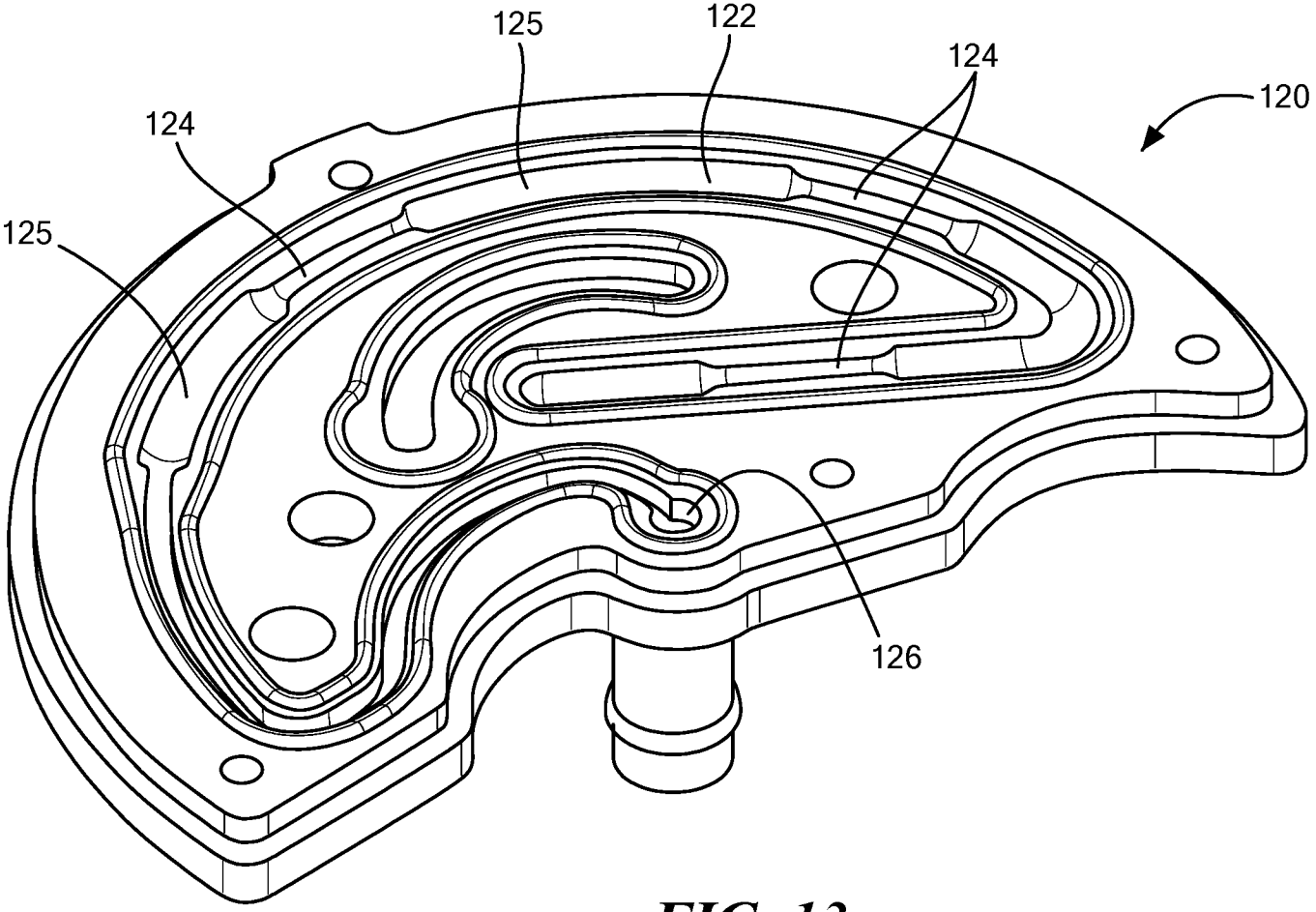
FIG. 13 is an isometric view of a flow restrictor of the dispenser of FIG. 1.
Figure 14:
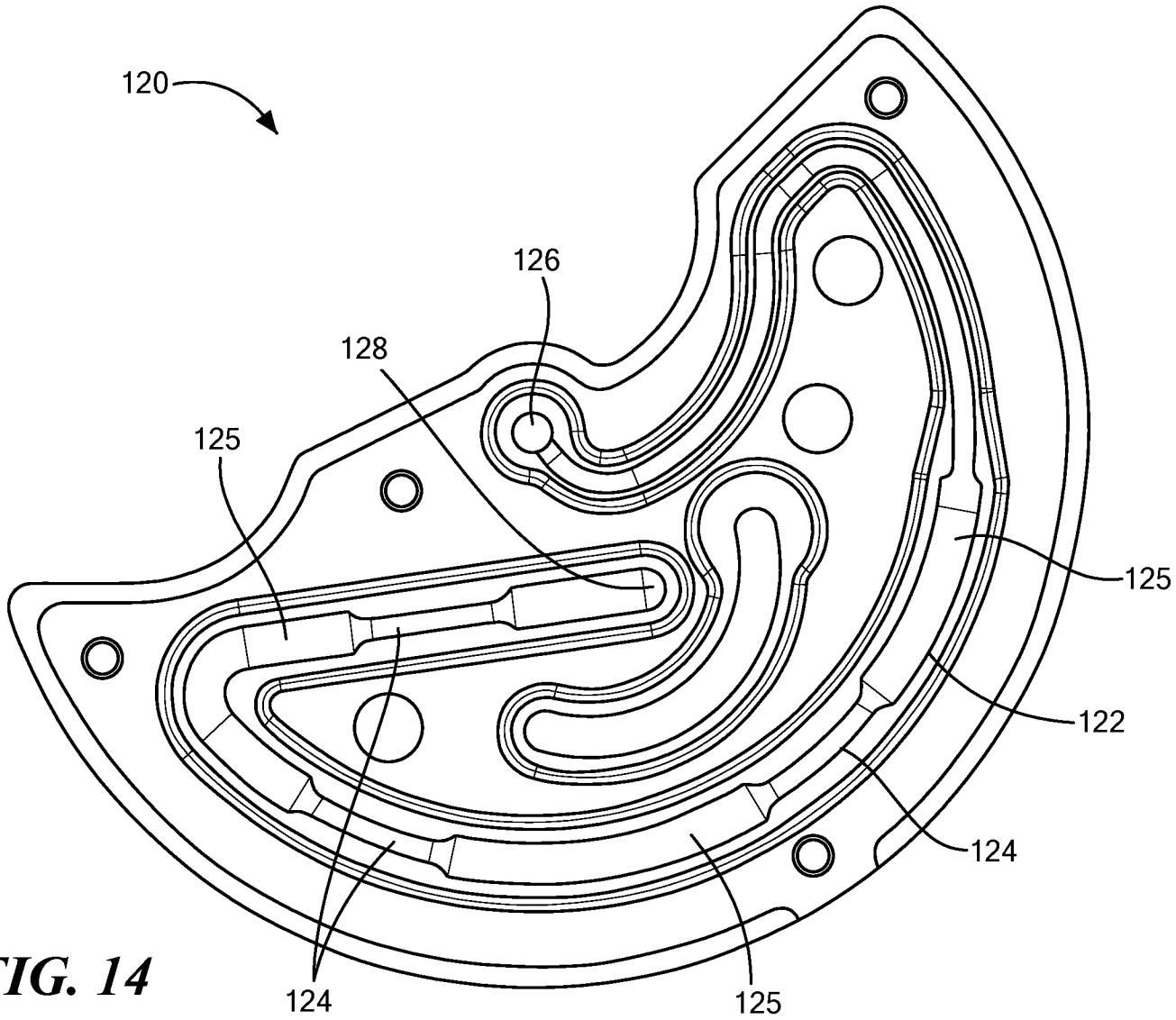
FIG. 14 is a top view of the flow restrictor of FIG. 13.

As noted above, a flow restrictor 120 can be provided on the flow path between the reservoir and the pump. The flow restrictor can reduce the flow rate of soap solution in transit from the reservoir to the pump. Referring to FIGS. 13 and 14, the flow restrictor can include a flow channel 122 having multiple internal constrictions or constricted sections 124 therein from an inlet 126 at the reservoir to an outlet 128 to the pump. The channel configuration can have the effect of assisting in alternating the output of air and soap solution from the outlet of the pump, rather than a more homogeneous mix of soap solution and air, which helps the disrupter more effectively generate the foam. The percentage of air in the output from the pump can be effectively controlled by the configuration of the flow restrictor. For example, in some embodiments, the constricted sections 124 of the channel through the flow restrictor can have a diameter of 1.5 mm and the wider sections 125 can have a diameter of 3.0 mm.

Alternatively, a low flow air intake mixing valve can be provided at an outlet of the reservoir and an inlet to the pump, through which the soap solution is withdrawn by the pump and mixed with air to begin foam production.

Particularly with the reservoir located below the pump, it is desirable to achieve an optimal balance between the flow rate of the pump, the flow restrictor (or air intake valve if present), and the pressure within the reservoir. To assist with this balance, the breather valve or pressure relief valve 76 can be used to backfill the sealed reservoir with air to minimize or prevent a pressure differential as the soap solution is pumped out.

Referring to FIGS. 15-24, the disrupter 28 includes an internal passage 142 on the flow path from an inlet to an outlet, with a convoluted surface 144 forming a substantial part of the internal passage. The convoluted surface includes surface features or shapes 146 arranged to form channels 148 along which or through which the soap solution can flow and mix with air. Sufficient surface features or shapes can be provided to allow the soap solution and air to collide with the channel walls as they flow through the disrupter, thereby further mixing air into the soap solution and volumizing the foam. The use of a disrupter having a convoluted surface is advantageous for foam generation, because it has no moving parts and does not require a motor.

In the embodiment shown in FIGS. 19-24, the convoluted surface 144 is formed from a plurality of crossing channels 148 formed in one or more surfaces of the internal passage within the disrupter. The crossing channels can be formed by a plurality of shapes 146 extending from or formed within one or more surfaces of the internal passages within the disrupter. A variety of shapes can be used, such as diamond shapes (shown in FIG. 19-24), triangular shapes, rectangular shapes, square shapes, circular shapes, oval shapes, ellipsoidal shape, or irregular shapes. The sharpness of the edges of the surface features or shapes can vary. Surface features or shapes can be provided in both surfaces of each of two opposing surfaces in the stacked plates.

Figure 15:
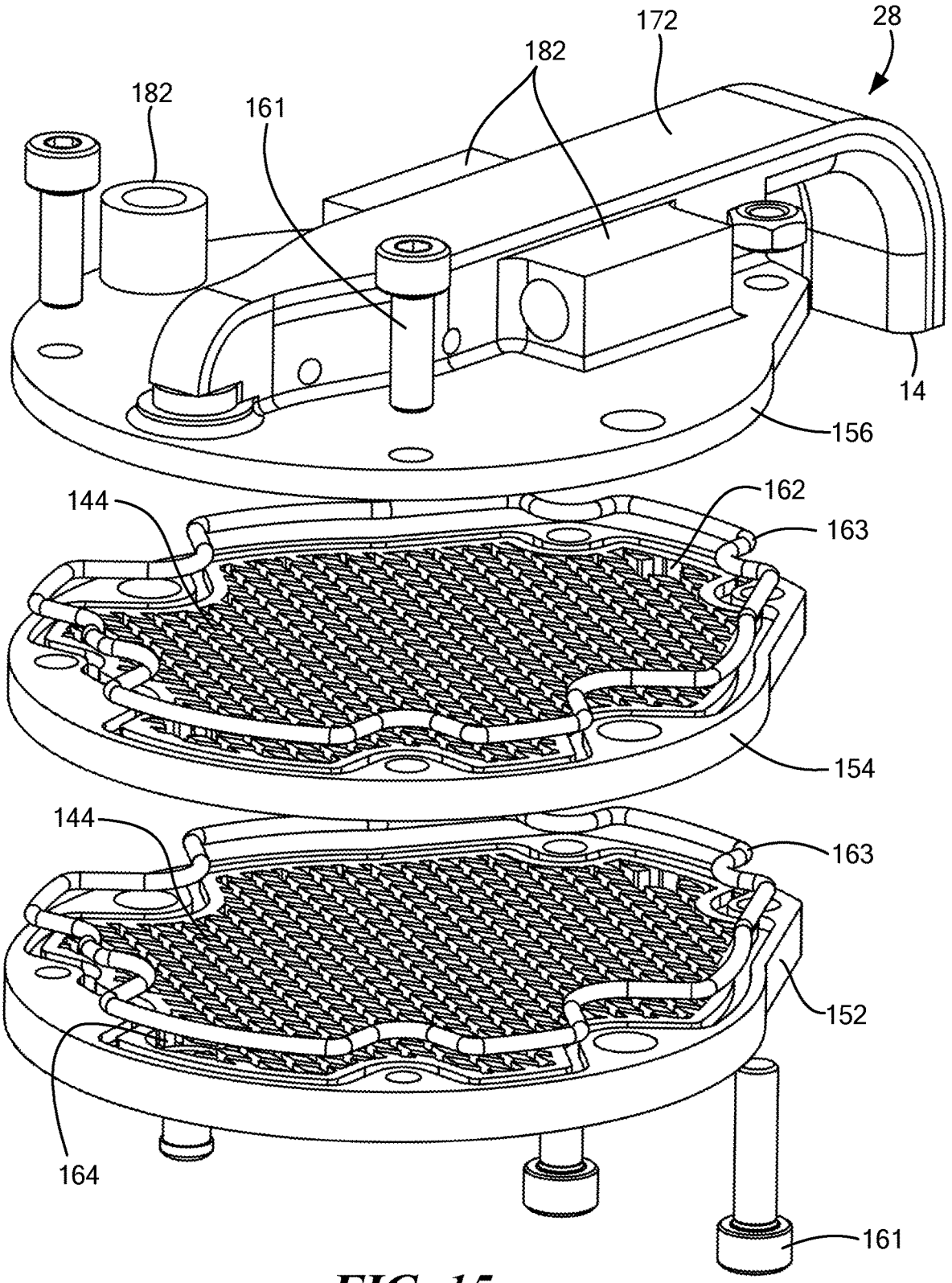
FIG. 15 is an exploded view of a disrupter and heating assembly of the dispenser of FIG. 1.
Figure 16:
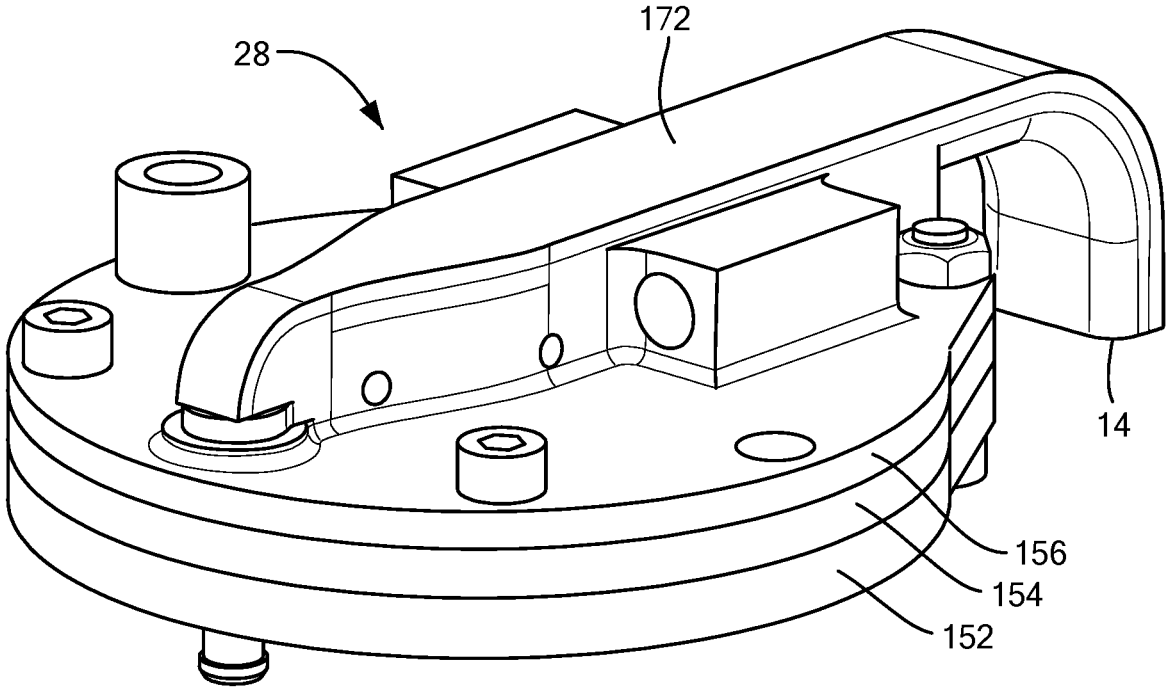
FIG. 16 is an assembled view of the disrupter and heating assembly of FIG. 15.
Figure 17:
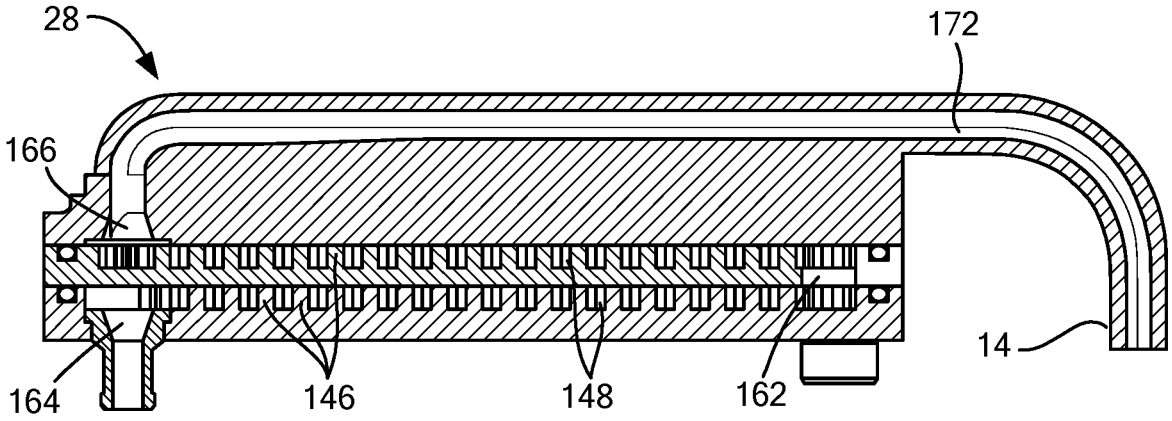
FIG. 17 is a sectional view of the disrupter of FIG. 16.

In some embodiments, the disrupter 28 can be a body having an internal passage 142 disposed within the body on the flow path, the convoluted surface 144 forming a part of the passage. In some embodiments, the disrupter can be a stack of at least two plates, a passage between the at least two plates on the flow path, the convoluted surface forming a part of the passage. FIGS. 15-17 illustrate a disrupter having a stack of three plates, a bottom plate 152, a middle plate 154, and a top plate 156. The plates can be fastened together in any suitable manner, such as with bolts or screws 161. Sealing elements 163 can be provided around the perimeters of the plates, for example, in perimeter channels.

A first or lower portion of a convoluted surface 144 extends between the bottom plate 152 and the middle plate 154, and a second or upper portion of the convoluted surface 144 extends between the middle plate 154 and the top plate 156. An aperture 162 is provided through the middle plate 154 from the lower portion of the convoluted surface to the upper portion of the convoluted surface. Soap solution enters the disrupter through an opening 164 in the bottom plate, flows along the lower portion of the convoluted surface, passes through the aperture 162 in the middle plate, and flows along the upper portion of the convoluted surface to an outlet 166 in the top plate. The convoluted surface can provide a widening of the flow path, so that the foam can spread over a greater surface area of the plates. From the outlet in the top plate, the foam can pass upwardly into a conduit 172 that leads across an upper surface of the top plate to the nozzle 14.

Figure 18:
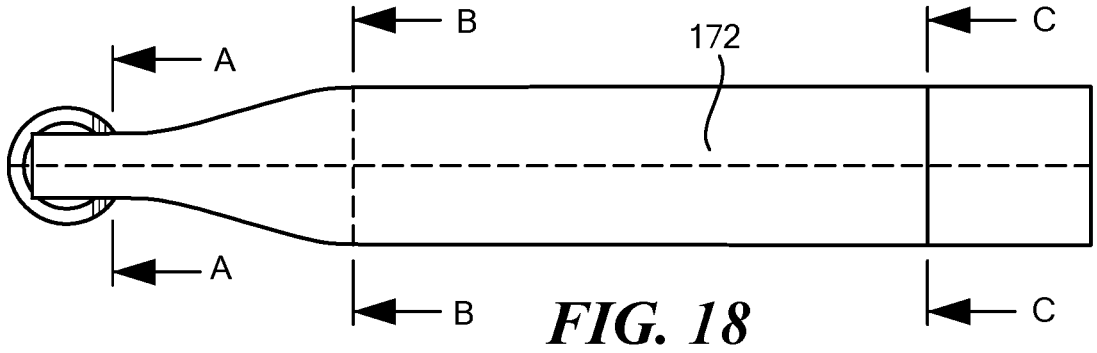
FIG. 18 is top view of a conduit of the disrupter of FIG. 16.
Figure 19:
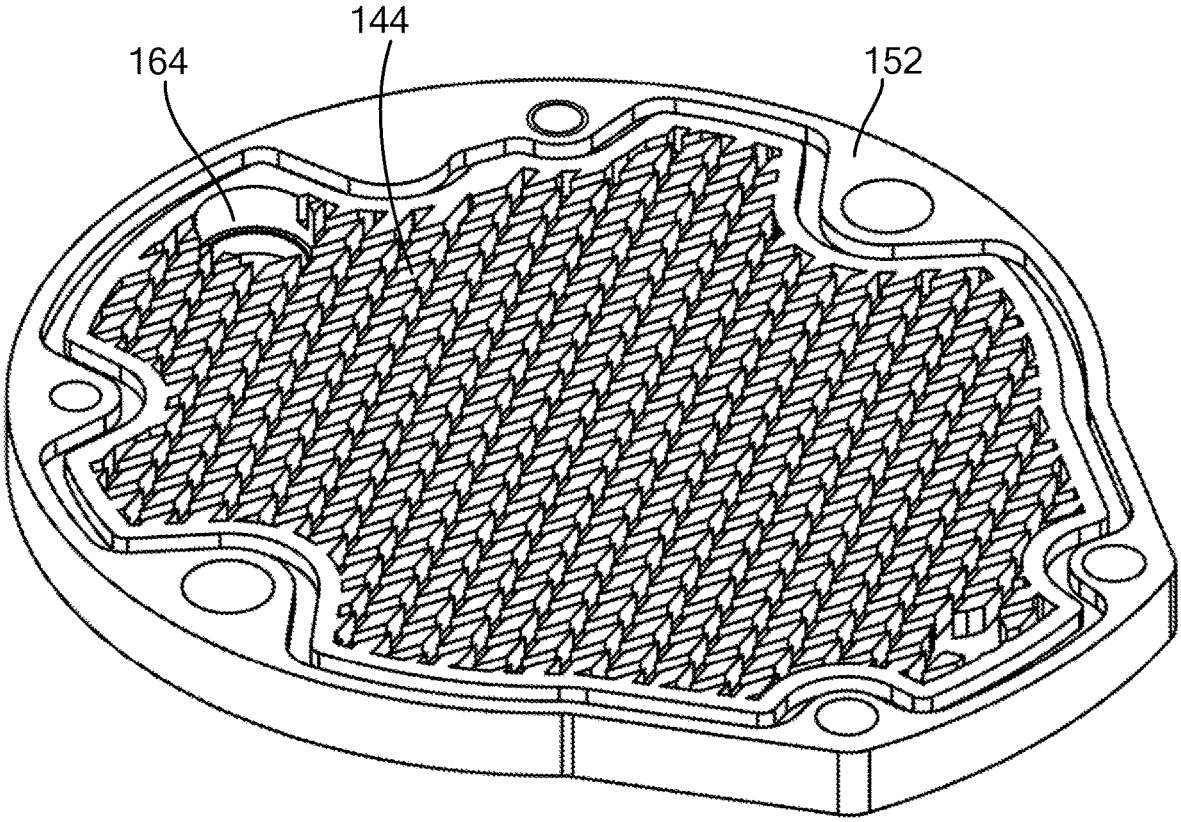
FIG. 19 is an isometric view of a bottom plate of the disrupter of FIG. 16.
Figure 20:
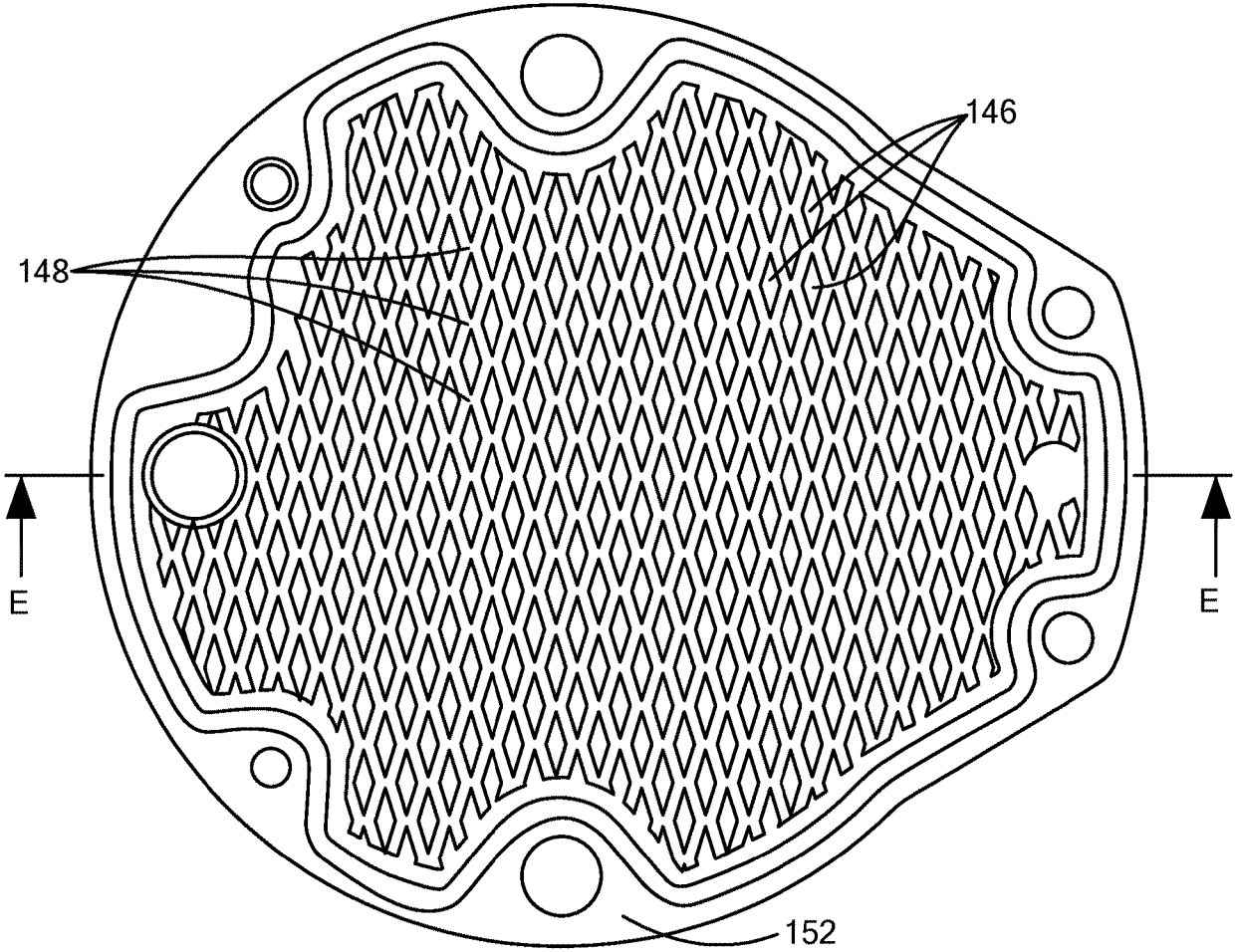
FIG. 20 is a top view of the bottom plate of FIG. 19.
Figure 21:
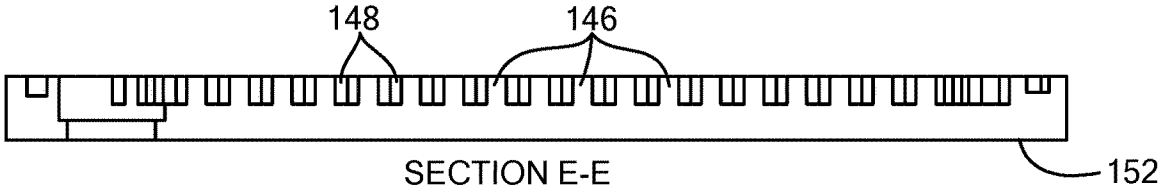
FIG. 21 is a sectional view of the bottom plate of FIG. 20.
Figure 22:
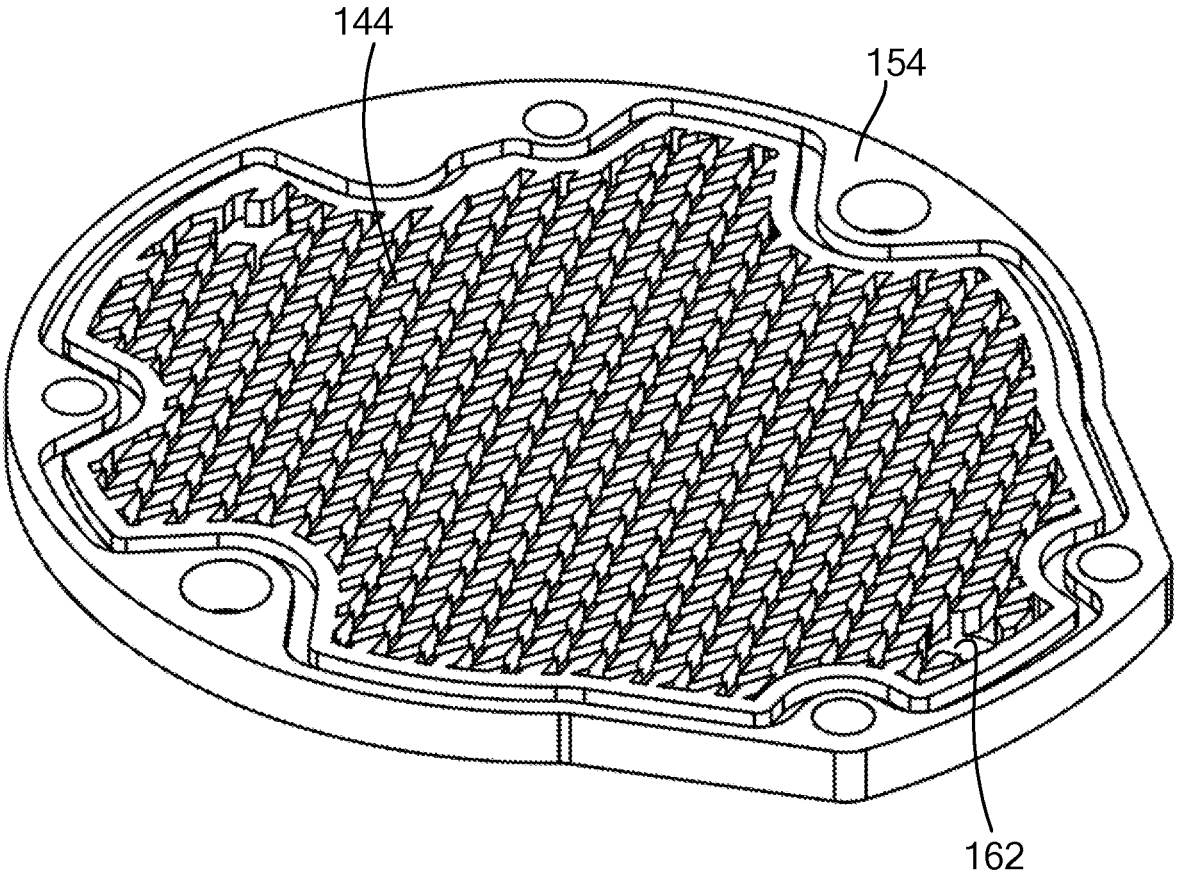
FIG. 22 is an isometric view of a middle plate of the disrupter of FIG. 16.
Figure 23:
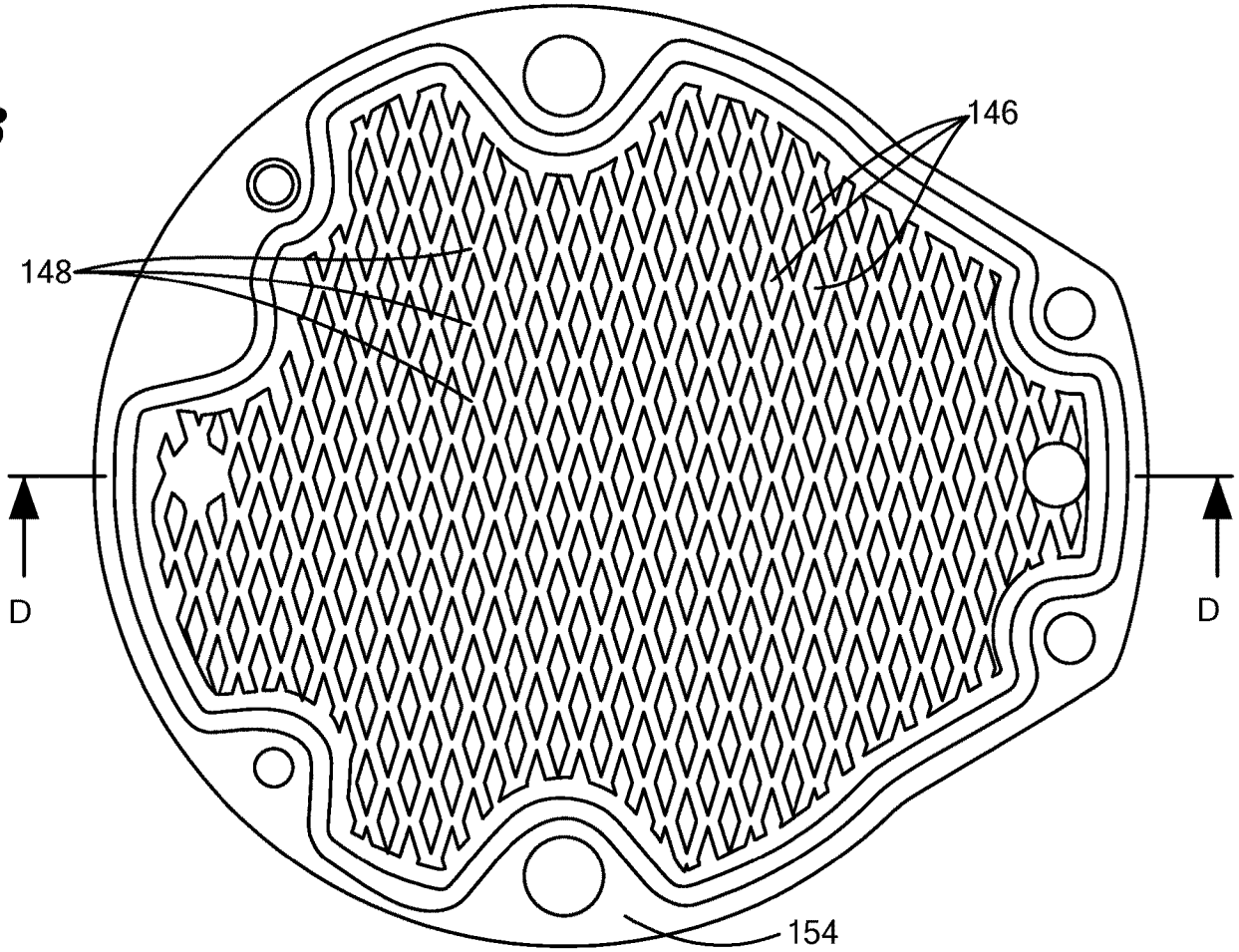
FIG. 23 is a top view of the middle plate of FIG. 22.
Figure 24:
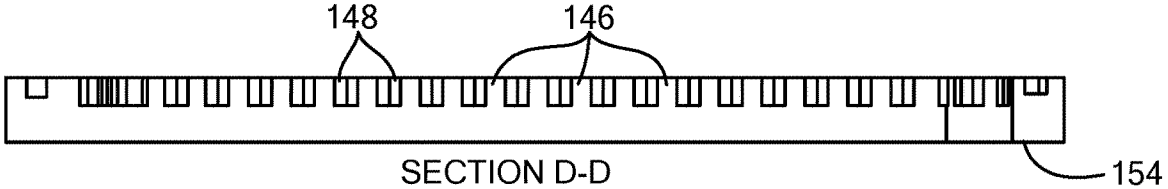
FIG. 24 is a sectional view of the middle plate of FIG. 23.

The length of the flow path through the disrupter plates 152, 154, and 156 and through the conduit 172 across the top plate 156 can contribute to a good foam consistency having a uniform small bubble size at the outlet of the nozzle 14. The conduit extending from the rear of the housing to the nozzle at the front of the housing can be configured to provide a sufficient length downstream of the disrupter plates to help the foam to consolidate to a continuous flow of small bubble lather with an optimal cushion (foam density) and slick (foam wetness) and to provide an optimal dwell time to provide a uniform temperature as the foam exits the nozzle. Cushion and slick tend to be subjective, so the conduit can be configured as appropriate for the desired application and users. For example, the aperture or outlet 166 in the top plate 156 to the conduit 172 can have a cross sectional area smaller than the cross-sectional area of the conduit to allow the foam to expand into the space in the conduit. Referring to FIG. 18, for example, in some embodiments, the cross-sectional area at cross-section A can be 9.1 $mm^2$, and the cross-sectional area from cross-sections B to C to the nozzle can have the same shape and a cross-sectional area of 25.4 $mm^2$. In some embodiments, the cross sectional area at the nozzle 14 can also be reduced from that of the conduit to allow the foam to consolidate to provide a more optimal cushion and slick.

Referring to FIGS. 7, 8, 15, and 16, the heating assembly 32 can include one or more heating elements 182 within the disrupter plates 152, 154, 156, and along the conduit 172 to the nozzle 14, so that the foam is heated as it flows therethrough. The disrupter plates and the conduit can be formed of a heat conductive material to provide sufficient heat transfer to the foam therein. The heat conductive material can be a metal or other material. A suitable metal material can be aluminum or an aluminum alloy. Other materials, such as copper, a copper alloy, brass, and a stainless steel, can be used.

One or several heating elements 182 can be provided in apertures extending through the disrupter plates 152, 154, 156, for example, about its perimeter. One or several heating elements 182 can be located alongside the conduit 172. Any suitable number of heating elements can be used, and the heating elements can be placed in any desired locations. Any suitable heating element can be used, for example, a cartridge heater, such as a tubular resistive heating element, or a Peltier heater. Suitable thermal insulation can be provided around the disrupter.

One or more temperature sensors 184 and/or one or more thermostats can be located in suitable positions for monitoring and controlling the heating elements. Suitable positions can include, for example, alongside the conduit and/or on a surface of the disrupter, such as on the top plate. One or more temperature sensors can be provided to determine the temperature of the heated foam. For example, a temperature sensor can be located at the outlet of the nozzle, to measure the temperature of the foam as it is discharged, and/or a temperature sensor can be located within the flow of the foam to measure the foam temperature directly.

In some devices, one or more negative temperature coefficient (NTC) thermistors can be as a temperature sensor that can provide suitably sensitive temperature measurements. For example, several NTC thermocouple heating elements along with one or more NTC thermistor sensors can provide accurate temperature measurements and a suitably rapid reaction time to ensure that the foam can be heated to and maintained within an appropriate temperature range. In some embodiments, the temperature sensor can be selected to maintain a relative accuracy of less than ±5%, which helps to ensure a safe lather temperature.

Using such heating elements, the heating assembly can be configured to heat the disrupter to appropriate temperatures. The disrupter can be configured such that the foam output is approximately 10° F. lower than the disrupter temperature. For example, the heating assembly can heat the disrupter to a temperature of approximately 150° F. to produce a foam output at the nozzle having a temperature of approximately 140° F.±5° F.

The device can raise the temperature of the shaving cream from ambient to a suitable temperature in a relatively rapid time. This temperature rise can be achieved by preheating the disrupter, formed of a suitably heat conductive material, along with the combination of the heating elements and sensors and the toggling control of the heating elements on and off to maintain the optimal temperature versus available power and desired run time. The heating assembly can raise the temperature of the disrupter from ambient to a suitable temperature range for heating the soap solution in about 1 to 3 minutes. In some embodiments, the heating assembly can raise the temperature of the disrupter from ambient to a suitable temperature range in less than 3 minutes or in less than 2 minutes.

Figure 9:
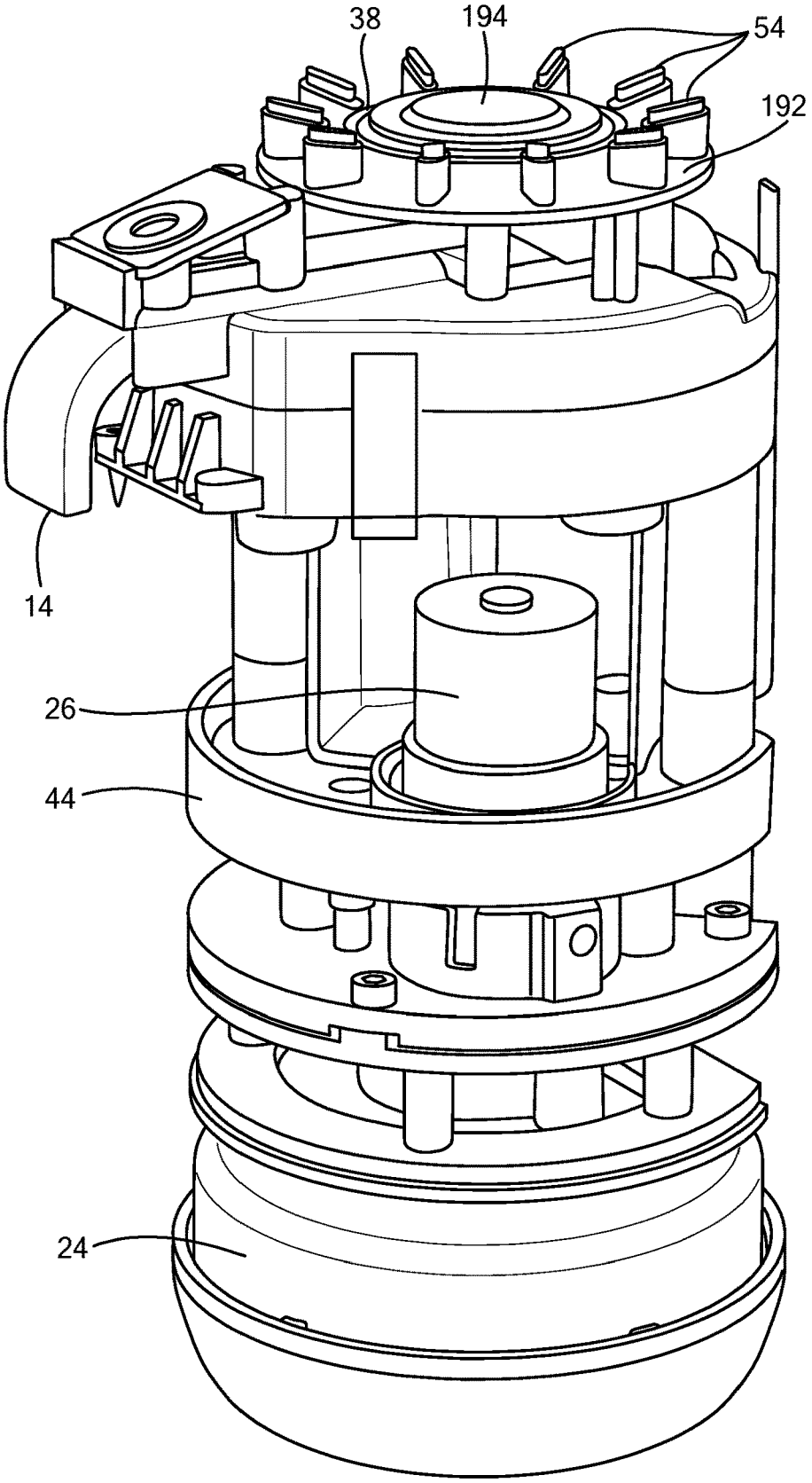
FIG. 9 is a still further isometric view of internal components of the dispenser of FIG. 1.
Figure 10:
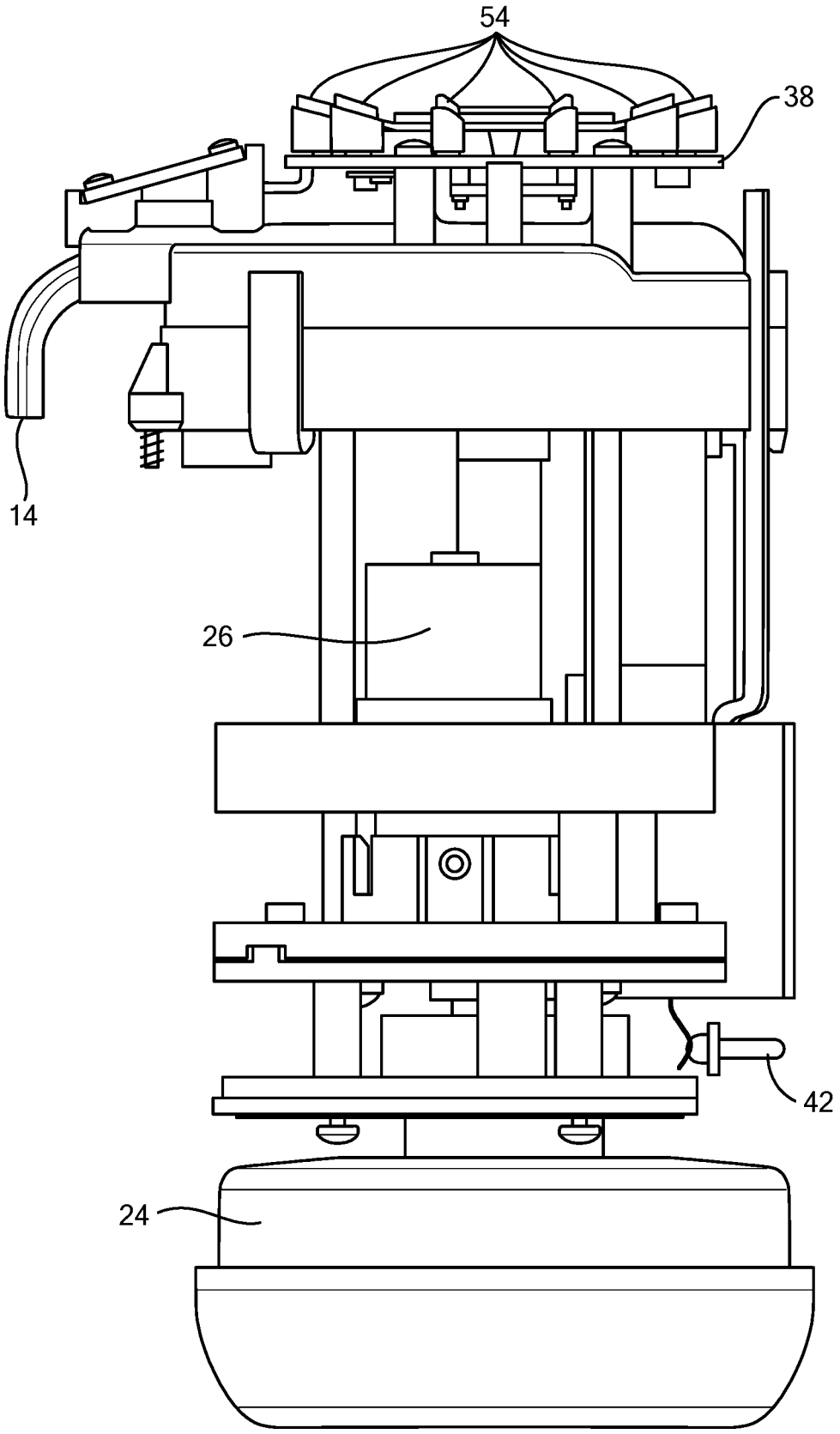
FIG. 10 is a still further isometric view of internal components of the dispenser of FIG. 1.

Electronic control circuitry 38 can be provided in communication with the heating assembly and the pump. Referring to FIGS. 9 and 10, the control circuitry can be located on a printed circuit board (PCB) 192 below an upper surface of the housing and above the disrupter. The upper surface of the housing can be formed of a flexible rubber or rubber-like insulating material sealed to the housing to prevent the entrance of moisture. A power switch 194 to turn the heating elements on, to begin heating up the disrupter, can be disposed on the PCB below a central area of the upper flexible surface. The flexible surface can serve as a button 16, such that depressing the central area of the upper flexible surface operates the power switch. For example, one push can turn the heating elements on and a further push can turn the heating elements off. The control circuitry can also be in communication with the dispense switch 196 on the upper surface to operate the pump to cause soap solution to flow through the heated disrupter and conduit and out through the nozzle. The switches can suitably be capacitive switches or pressure sensitive switches. A multifunction button can be provided that can activate a different function with a different pressing activation, for example, a single press, a double press, a press and hold, and the like can each activate a different function.

A dual or multi element temperature controlled heating assembly can be provided. Two or more heating elements can be used to heat the disrupter up to the initial operating temperature, after which the control circuitry can select one or more of the heating elements to maintain an optimum operating temperature to reduce energy consumption from the power source. The device can use a single heating element at a time and can selectively alternate between the multiple heating elements to maximize the active service life of each of the heating element components.

The control circuitry can include a shut off control if the sensed temperature gets too high, or if the device has been on for a determined amount of time. An electronics feedback system with failsafe can be provided. For example, a thermostat can be provided to monitor the temperature and maintain an optimum operating temperature or temperature range or a desired set point. A tandem failsafe monitoring system can run concurrently to ensure that, if a maximum temperature is exceeded, the heating elements are switched off and the pump is stopped to prevent hot lather being dispensed at a level deemed to be unsafe.

A lighting assembly, such as an array of LED lights 54, can be provided adjacent the upper surface of the housing, above the PCB for communication therewith, as shown in FIGS. 1, 2, 9, and 10. The lighting assembly can be used to provide an indication that power has been turned on and the device is heating the disrupter, and to indicate when a suitable temperature has been reached, such that the foam is ready to be dispensed. An indicator light can be provided when a cleaning cycle is needed. A variety of different light colors can be used. For example, one color of LED lights can be used to indicate the device is heating up, another color to indicate that the device is ready to dispense, and a further color to indicate that a cleaning cycle is needed. Any suitable LEDs, such as RGB LEDs can be used.

After the device has been idle for a time, particles in the soap solution may settle to the bottom of the reservoir. In some embodiments, a remixing cycle can be provided during an initial heating cycle, during which the system takes some time to reach full operating temperature. In the remixing cycle, the pump can recirculate the soap solution back into the reservoir to remix the soap solution. A remixing cycle can be useful when the soap solution is in a suspension that can settle over time, which may create a variable mix, not consistently optimized for creating a desired hot lather foam consistency. For example, when the soap solution is withdrawn from the bottom of the reservoir after settling, the solution may initially be too rich and may get progressively weaker as the soap solution is withdrawn. In some embodiments, shaking the device by hand can be sufficient to remix the soap solution. The device can also include a cleaning cycle. To run a cleaning cycle, a user can add a cleaning solution or water or a combination thereof to the reservoir and start the cleaning cycle, for example, by pressing an appropriate button, which can be the power button or a separate button. The device does not need to be disassembled for cleaning. In some embodiments, the flow path during the cleaning cycle is the same as the flow path taken by the soap solution during use in generating hot shaving cream. In some embodiments, the water or cleaning solution can pass through the device without generating a foam. In some embodiments, in a cleaning cycle, the outlet valve from the reservoir can be closed such that the pump operates to pump water or a cleaning solution through the pump and back to the reservoir. The device can include an indication from the electronics control that a cleaning cycle is needed, for example after a determined time has passed or the device has been used a determined number of times. During the cleaning cycle, the heating elements of the device can be disabled until the cleaning agent has been purged from the device. The cleaning agent can be purged via an alternative outlet to the dispenser outlet.

The dispenser can dispense a dose of a suitable amount of foam. For example, a dose can be about 8.6 g of hot shaving cream. The time to dispense can be less than 15 seconds. The dispenser can dispense hot shaving cream continuously while the dispense button is pressed. The device can be sized to deliver any desired number of doses. For example, a dispenser can dispense about 10 doses before the reservoir must be refilled.

The soap solution can be a mixture of about 20 mL of a liquid shave soap to about 80 mL of water. Liquid shave soaps are commercially available and can be used. Generally, tap water is suitable and can be used. The dispenser can provide foam of a consistent quality using water of any degree of hardness. The liquid shave soap can be supplied in pre-measured packets that can be opened by the user and added to the reservoir. The reservoir can include a fill line or other fill indicator, for example, to indicate an amount of water to be added once a liquid shave soap packet has been added to the reservoir.

The shape of the outlet of the nozzle can be oval or elongated, which also helps to produce a smooth lather or foam with uniformly sized small bubbles. In some embodiments, the nozzle can dispense hot shaving cream in different shapes. For example, a plate with a shaped opening can be located in the outlet of the nozzle.

Figure 25:
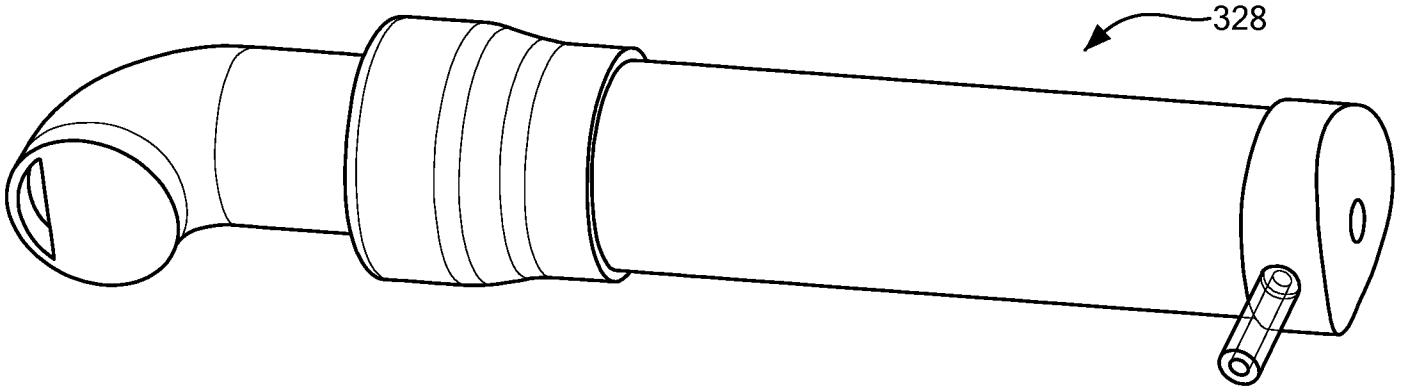
FIG. 25 is an isometric view of a further embodiment of a flow disrupter.
Figure 26:
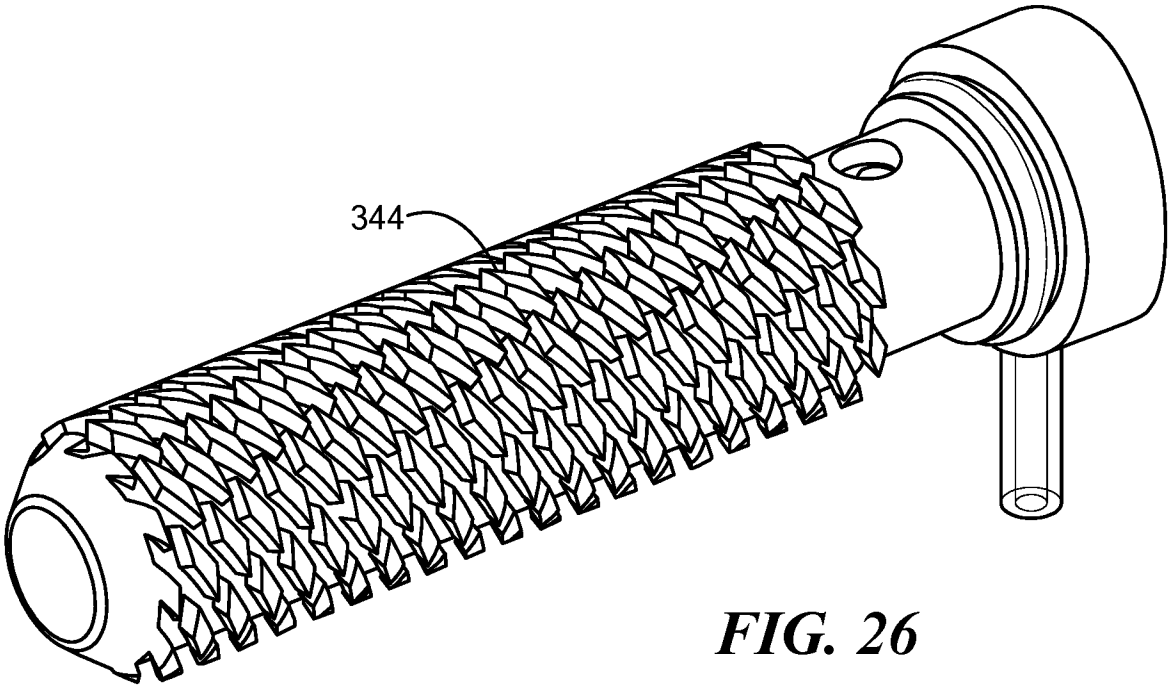
FIG. 26 is an isometric view of a component of the flow disrupter of FIG. 25.
Figure 27:
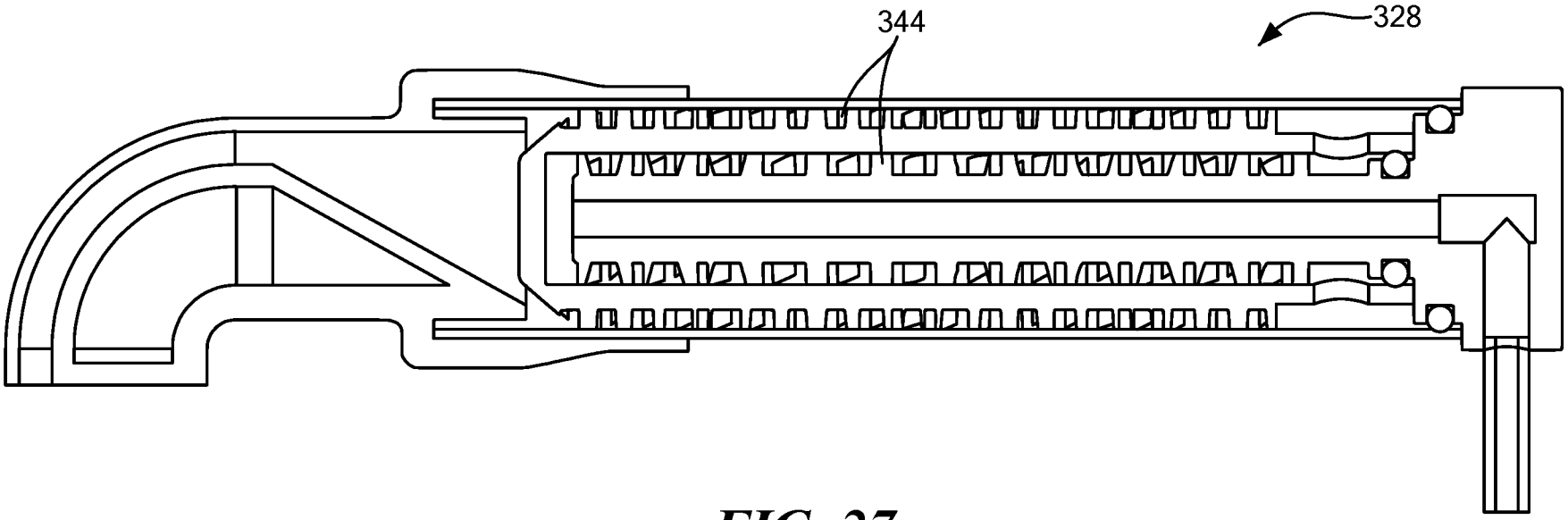
FIG. 27 is a sectional view of the flow disrupter of FIG. 25.

FIGS. 25-27 illustrate a further embodiment of a disrupter 328 in which a convoluted surface 344 is formed between coaxial cylinders.

In some embodiments, the flow of pumped soap solution can be split so that a correct amount enters the disrupter while the balance is remixed into the reservoir containing the soap solution.

In a further reservoir configuration, a helical tube can be provided within the reservoir through which the soap solution is withdrawn out of the reservoir by the pump. The helical tube has an inlet at the bottom of the reservoir and an outlet to the pump at the top of the reservoir. The angle of the helical tube and the inner diameter can be selected to help to ensure that the soap solution output from the reservoir does not vary as the volume in the reservoir and pressure head are reduced as the soap solution is withdrawn. Without the helical tube, the foam could become wetter, with larger bubbles, as the reservoir is emptied. A frame can be provided to retain the helical tube in position within the reservoir.

In some embodiments, a further type of encoded consumable can be added to the device for cleaning the internal workings. When fitted, the consumable can trigger operation of a cleaning cycle.

In some embodiments, a multi stage foaming turbine can be used to generate a foam. The multi stage foaming turbine can include at least an input stage having a lead screw type arrangement and an output stage having a paddle type arrangement. This configuration can provide a desirable foam consistency from a DC motor, operable at a size selected for low energy consumption and which may have inherently low maximum RPM capabilities and limited torque. A foaming turbine can be used in lieu of the disrupter described above.

Other aspects, embodiments, and features of the device and method include the following:

1. A hot shaving cream dispenser, comprising:

a housing, a nozzle for dispensing a foam extending from the housing;

a soap solution reservoir within the housing;

a flow path within the housing from the reservoir to the nozzle;

a disrupter on the flow path downstream from the reservoir, comprising a convoluted surface on the flow path to form a foam from soap solution flowing along the flow path;

a heating assembly disposed to provide heat to the foam on the flow path; and a pump disposed to pump soap solution from the reservoir through the disrupter to the nozzle along the flow path.

2. The dispenser of item 1, wherein the disrupter comprises a body, an internal passage disposed within the body on the flow path from an inlet to an outlet, the convoluted surface forming a part of the passage.

3. The dispenser of any of items 1-2, wherein the disrupter comprises a stack of at least two plates, a passage between the at least two plates on the flow path from an inlet to an outlet, the convoluted surface forming a part of the passage.

4. The dispenser of any of items 1-3, wherein the disrupter comprises a top plate, a middle plate, and a bottom plate, and a lower portion of the convoluted surface extends between the bottom plate and the middle plate and an upper portion of the convoluted surface extends between the middle plate and the top plate, and an aperture is provided through the middle plate from the lower portion of the convoluted surface to the upper portion of the convoluted surface.

5. The dispenser of item 4, wherein the disrupter includes a sealing element disposed about a perimeter between the bottom plate and the middle plate and between the middle plate and the top plate.

6. The dispenser of any of items 1-5, wherein the convoluted surface comprises a plurality of crossing channels formed in one or more surfaces of an internal passage within the disrupter.

7. The dispenser of item 6, wherein the crossing channels are formed by a plurality of shapes extending from or formed within one or more surfaces of the internal passage within the disrupter.

8. The dispenser of item 7, wherein the plurality of shapes include diamond shapes, triangular shapes, rectangular shapes, square shapes, circular shapes, oval shapes, ellipsoidal shapes, or irregular shapes.

9. The dispenser of any of items 1-8, wherein the heating assembly comprises one or more heating elements disposed in heat transfer communication with the disrupter.

10. The dispenser of item 9, wherein the disrupter is formed of a heat conductive material, the heat conductive material comprising a metal material.

11. The dispenser of item 10, wherein the metal material comprises aluminum, an aluminum alloy, copper, a copper alloy, brass, or a stainless steel.

12. The dispenser of any of items 1-11, wherein the disrupter includes a disputer outlet disposed at approximately an opposite side of the housing from the nozzle, and a conduit between the disrupter outlet and the nozzle, the conduit overlying an upper surface of the disrupter.

13. The dispenser of item 12, wherein the heating assembly comprises one or more heating elements disposed in heat transfer communication with the conduit overlying the upper surface of the disrupter.

14. The dispenser of any of items 1-13, wherein the heating assembly comprises one or more heating elements disposed in heat transfer communication with the disrupter.

15. The dispenser of item 14, wherein the heating elements comprise a cartridge heater or a Peltier heater.

16. The dispenser of any of items 14-15, wherein the heating assembly further comprises a temperature sensor located to determine a temperature of foam dispensed through the nozzle.

17. The dispenser of any of items 14-16, wherein the heating assembly further comprises temperature control circuitry including a temperature sensor, the temperature control circuitry operative to switch the one or more heating elements to maintain a temperature of foam at a desired set point or within a desired range.

18. The dispenser of any of items 1-17, wherein the pump is disposed within the housing between the soap solution reservoir and the disrupter.

19. The dispenser of any of items 1-18, wherein the pump comprises a membrane pump or a diaphragm pump including a valve to regulate flow of a soap solution from the soap solution reservoir and a valve to regulate a flow of air to provide a flow of alternating air and soap solution.

20. The dispenser of any of items 1-19, wherein the pump provides a foam comprising at least about 50% air by volume and preferably at least 94%±2% by volume.

21. The dispenser of any of items 1-20, wherein the soap solution reservoir is disposed in a lower region of the housing below the pump, and an outlet from the soap solution reservoir is provided on the flow path to an inlet to the pump.

22. The dispenser of any of items 1-21, wherein the soap solution reservoir comprises a container removably fixable within a lower region of the housing, and an outlet is disposed on an upper portion of the container, the outlet fixable on the flow path to an inlet to the pump.

23. The dispenser of item 22, wherein the soap solution reservoir further includes a tube extending from an opening adjacent a bottom of the container to the outlet at the top of the container.

24. The dispenser of any of items 1-23, wherein the soap solution reservoir includes a translucent or transparent bottom surface and a fill level indicator on the bottom surface, whereby a user can visually determine a level of soap solution within the soap solution reservoir.

25. The dispenser of any of items 1-24, further comprising a locking mechanism in the housing to fix the soap solution reservoir within the housing in a locked position.

26. The dispenser of any of items 1-25, wherein the soap solution reservoir includes finger grips on a bottom surface configured for a user to rotate the soap solution reservoir in one direction to insert the soap solution reservoir in the housing and in an opposite direction to remove the soap solution reservoir from the housing.

27. The dispenser of any of items 1-26, further comprising a flow restrictor configured to reduce a flow rate of soap solution from the soap solution reservoir to the pump to provide an alternating output of air and soap solution from the pump to the disrupter.

28. The dispenser of any of items 1-27, further comprising a flow restrictor between the outlet of the reservoir and the inlet to the pump, the flow restrictor comprising a plurality of flow path restrictions to reduce a flow rate of soap solution from the soap solution reservoir to the pump.

29. The dispenser of any of items 1-28, wherein the housing is sealed between a top of the reservoir and the nozzle to minimize liquid leakage.

30. The dispenser of any of items 1-29, further comprising a breather valve disposed to introduce ambient air into the reservoir.

31. The dispenser of any of items 1-30, further comprising a power source in communication with the pump and the heating assembly.

32. The dispenser of item 31, wherein the power source comprises one or more batteries disposed within the housing.

33. The dispenser of any of items 31-32, further comprising a charging port disposed within the housing, the power source in electrical communication with the charging port, the charging port configured to receive a charging cable, whereby the power source can be periodically recharged.

34. The dispenser of item 33, wherein the charging port is disposed on a lower portion of the housing on a side opposite the nozzle.

35. The dispenser of any of items 1-34, further comprising electronic control circuitry in communication with the pump and the heating assembly, the control circuitry including a power switch to turn the heating assembly on and off, and a dispense switch to turn on the pump to dispense a hot foam lather through the nozzle.

36. The dispenser of item 35, wherein the electronic control circuitry includes one or more temperature sensors and the control circuitry is operative to turn the heating assembly off after a predetermined time or when one or more of the temperature sensors reach a predetermined temperature threshold.

37. The dispenser of any of items 35-36, wherein one or both of the power switch and the dispense switch include a pressure sensitive switch or a capacitive switch operable by a user.

38. The dispenser of any of items 35-37, wherein the housing includes a flexible upper surface, and one or both of the power switch and the dispense switch are operable by a user by depressing a portion of the flexible upper surface.

39. The dispenser of any of items 35-8, further comprising a lighting assembly disposed in an upper surface of the housing, the electronic control circuitry in communication with the lighting assembly to illuminate light indicators indicative of heating operation.

40. The dispenser of any of items 35-39, wherein the electronic control circuitry includes a circuit board disposed in an upper portion of the housing.

41. The dispenser of any of items 1-40, wherein the housing includes an anti-slip material on a bottom surface.

42. A method of producing a hot shaving cream lather comprising:

providing the hot shaving cream dispenser of any of items 1-41 with a soap solution in the soap solution reservoir;

operating a power switch to turn on the heating assembly; and operating a dispense switch to dispense a hot shaving cream lather through the nozzle.

43. The method of item 42, wherein the dispenser provides a visible and/or audible indication to a user when the heating assembly has a reached a temperature sufficient to heat soap solution flowing therethrough to a predetermined temperature.

44. The method of any of items 42-43, wherein the dispenser produces a foam output at the nozzle having a temperature approximately 10° F. less than a temperature of the disrupter.

45. The method of any of items 42-44, wherein the dispenser heats the disrupter to a temperature of approximately 150° F. and to produce a foam output at the nozzle having a temperature of approximately 140° F.

46. The dispenser of any of items 42-45, wherein the dispenser heats the disrupter to a temperature of 150° F. from ambient in about 2 minutes.

47. The method of any of items 42-46, wherein the pump of the dispenser mixes air into a soap solution to provide a foam having at least 85% air by volume and preferably at least 94%±
2% air by volume.

48. The method of any of items 42-47, wherein the dispenser includes a flow restrictor to reduce a flow rate of soap solution from the soap solution reservoir to the pump to provide an alternating output of air and soap solution from the pump to the disrupter.

49. The method of any of items 42-48, further comprising refilling the soap solution reservoir with additional soap solution or removing the soap solution reservoir and inserting a new soap solution reservoir.

As used herein, "consisting essentially of" allows the inclusion of materials or steps that do not materially affect the basic and novel characteristics of the claims. Any recitation herein of the term "comprising," particularly in a description of components of a composition or in a description of elements of a device, can be exchanged with "consisting essentially of" or "consisting of."

It will be appreciated that the various features of the embodiments and aspects described herein can be combined in a variety of ways. For example, a feature described in conjunction with one embodiment or aspect may be included in another embodiment or aspect even if not explicitly described in conjunction with that embodiment or aspect.

To the extent that the appended claims have been drafted without multiple dependencies, this has been done only to accommodate formal requirements in jurisdictions that do not allow such multiple dependencies. It should be noted that all possible combinations of features that would be implied by rendering the claims multiply dependent are explicitly envisaged and should be considered part of the technology described herein.

The present technology has been described in conjunction with certain preferred embodiments or aspects. It is to be understood that the technology is not limited to the exact details of construction, operation, exact materials or embodiments or aspects shown and described, and that various modifications, substitutions of equivalents, alterations to the compositions, and other changes to the technology disclosed herein will be apparent to one of skill in the art.

What is claimed is:

1. A hot shaving cream dispenser, comprising:

a housing, a nozzle for dispensing a foam extending from the housing;

a soap solution reservoir within the housing;

a flow path within the housing from the reservoir to the nozzle;

a disrupter on the flow path downstream from the reservoir, comprising a convoluted surface on the flow path to form a foam from soap solution flowing along the flow path, wherein the convoluted surface comprises a plurality of crossing channels formed in one or more surfaces of an internal passage within the disrupter, and the crossing channels are formed by a plurality of shapes extending from or formed within one or more surfaces of the internal passage within the disrupter;

a heating assembly disposed to provide heat to the foam on the flow path;

a pump disposed to pump soap solution from the reservoir through the disrupter to the nozzle along the flow path; and a power source in communication with the pump and the heating assembly, wherein the power source comprises one or more batteries disposed within the housing and further comprising a charging port disposed within the housing, the power source in electrical communication with the charging port, the charging port configured to receive a charging cable, whereby the one or more batteries can be periodically recharged.

2. The dispenser of claim 1, wherein the disrupter comprises a body, an internal passage disposed within the body on the flow path from an inlet to an outlet, the convoluted surface forming a part of the passage.

3. The dispenser of claim 1, wherein the disrupter comprises a top plate, a middle plate, and a bottom plate, and a lower portion of the convoluted surface extends between the bottom plate and the middle plate and an upper portion of the convoluted surface extends between the middle plate and the top plate, and an aperture is provided through the middle plate from the lower portion of the convoluted surface to the upper portion of the convoluted surface.

4. The dispenser of claim 1, wherein the heating assembly comprises one or more heating elements disposed in heat transfer communication with the disrupter.

5. The dispenser of claim 4, wherein the heating assembly further comprises temperature control circuitry including a temperature sensor, the temperature control circuitry operative to switch the one or more heating elements to maintain a temperature of foam at a desired set point or within a desired range.

6. The dispenser of claim 1, wherein the pump comprises a membrane pump or a diaphragm pump including a valve to regulate flow of a soap solution from the soap solution reservoir and a valve to regulate a flow of air to provide a flow of alternating air and soap solution.

7. The dispenser of claim 1, further comprising a flow restrictor configured to reduce a flow rate of soap solution from the soap solution reservoir to the pump to provide an alternating output of air and soap solution from the pump to the disrupter.

8. The dispenser of claim 1, wherein the housing is sealed between a top of the reservoir and the nozzle to minimize liquid leakage.

9. The dispenser of claim 1, further comprising electronic control circuitry in communication with the pump and the heating assembly, the control circuitry including a power switch to turn the heating assembly on and off, and a dispense switch to turn on the pump to dispense a hot foam lather through the nozzle.

10. The dispenser of claim 9, wherein the electronic control circuitry includes one or more temperature sensors and the control circuitry is operative to turn the heating assembly off after a predetermined time or when one or more of the temperature sensors reach a predetermined temperature threshold.

11. The dispenser of claim 9, further comprising a lighting assembly disposed in an upper surface of the housing, the electronic control circuitry in communication with the lighting assembly to illuminate light indicators indicative of heating operation.

* * * * *